US010580253B2

(12) United States Patent
Beria et al.

(10) Patent No.: US 10,580,253 B2
(45) Date of Patent: Mar. 3, 2020

(54) GAMING MACHINE, CONTROL METHOD FOR A GAMING MACHINE, AND PROGRAM FOR GAMING MACHINE

(71) Applicant: Konami Gaming, Inc., Las Vegas, NV (US)

(72) Inventors: Majgan Beria, Las Vegas, NV (US); John Pariseau, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/973,627

(22) Filed: May 8, 2018

(65) Prior Publication Data

US 2019/0347896 A1 Nov. 14, 2019

(51) Int. Cl.
*G07F 17/32* (2006.01)

(52) U.S. Cl.
CPC ..... *G07F 17/3213* (2013.01); *G07F 17/3255* (2013.01); *G07F 17/3258* (2013.01); *G07F 17/3262* (2013.01); *G07F 17/3267* (2013.01)

(58) Field of Classification Search
CPC ..... G07F 17/3213; G07F 17/3255; G07F 17/3258; G07F 17/3262; G07F 17/3267
USPC ..... 463/20
See application file for complete search history.

(56) References Cited

U.S. PATENT DOCUMENTS

2005/0054425 A1* 3/2005 Adams ..... G07F 17/32 463/20
2009/0325687 A1* 12/2009 Kelly ..... G07F 17/32 463/26
2014/0073391 A1* 3/2014 Lin ..... G07F 17/3209 463/16
2015/0080109 A1* 3/2015 Holsclaw ..... G07F 17/3262 463/25
2015/0302700 A1* 10/2015 Zielinski ..... G07F 17/3227 463/20
2016/0093139 A1* 3/2016 Zielinski ..... G07F 17/34 463/20

* cited by examiner

*Primary Examiner* — Allen Chan
(74) *Attorney, Agent, or Firm* — Howard & Howard Attorneys PLLC

(57) ABSTRACT

A gaming machine provides a game feature. The gaming machine includes an operation unit, a display unit, a memory device and a game control unit. The operation unit receives an operation input of the player. The display unit is configured to display a game screen including computer generated graphics. The memory device stores a game execution program including computer instructions for generating the game feature. The game control unit executes the game execution program to provide the game feature and is coupled to the operation unit, the display unit and the memory device. The game control unit includes a processor programmed to display a game feature structure on the game screen on the display unit. The game feature structure includes a wheel having a plurality of wedges. Each wedge has an associated indicia. The indicia are from a set of indicia which includes a plurality of prize symbols.

33 Claims, 31 Drawing Sheets

FIG. 4

72 74 76 78 80

| | | | | |
|---|---|---|---|---|
| PicB | Wild | PicB | PicD | Trigger |
| Q | Wild | Trigger | 9 | PicA |
| K | Wild | J | 10 | 10 |
| PicA | Q | Q | Trigger | A |
| 9 | 9 | PicD | PicD | PicA |
| J | J | Wild | Q | K |
| K | Trigger | J | A | 10 |
| PicA | PicB | Q | Wild | 9 |
| 9 | 10 | PicA | Wild | Wild |
| Trigger | PicA | A | Wild | Wild |
| J | Wild | K | PicB | Wild |
| PicC | Wild | PicA | inn | PicC |
| Wild | Wild | A | inn | PicB |
| Wild | inn | J | inn | 10 |
| Wild | inn | inn | inn | inn |
| A | inn | inn | inn | inn |
| Q | inn | inn | J | inn |
| PicD | inn | Wild | Q | inn |
| J | A | Wild | PicC | inn |
| inn | J | Wild | A | PicA |

84

82

86

90

64

136

260

262

264

| | R1 | R2 | R3 | R4 | R5 |
|---|---|---|---|---|---|
| 1 | PicB | Wild | PicB | PicD | Trigger |
| 2 | Q | Wild | Trigger | 9 | PicA |
| 3 | K | Wild | J | 10 | 10 |
| 4 | PicA | Q | Q | Trigger | A |
| 5 | 9 | 9 | PicD | PicD | PicA |
| 6 | J | J | Wild | Q | K |
| 7 | K | Trigger | J | A | 10 |
| 8 | PicA | PicB | Q | Wild | 9 |
| 9 | 9 | 10 | PicA | Wild | Wild |
| 10 | Trigger | PicA | A | Wild | Wild |
| 11 | J | Wild | K | PicB | Wild |
| 12 | PicC | Wild | PicA | inn | PicC |
| 13 | Wild | Wild | A | inn | PicB |
| 14 | Wild | inn | J | inn | 10 |
| 15 | Wild | inn | inn | inn | inn |
| 16 | A | inn | inn | inn | inn |
| 17 | Q | inn | inn | J | inn |
| 18 | PicD | inn | Wild | Q | inn |
| 19 | J | A | Wild | PicC | inn |
| 20 | inn | J | Wild | A | PicA |

FIG. 13

138

| Stop Position | Random Number Range |
|---|---|
| 1 | 1-50 |
| 2 | 51-100 |
| 3 | 101-150 |
| 4 | 151-200 |
| 5 | 201-250 |
| 6 | 251-300 |
| 7 | 301-350 |
| 8 | 351-400 |
| 9 | 401-450 |
| 10 | 451-500 |
| 11 | 501-550 |
| 12 | 551-600 |
| 13 | 601-650 |
| 14 | 651-700 |
| 15 | 701-750 |
| 16 | 751-800 |
| 17 | 801-850 |
| 18 | 851-900 |
| 19 | 901-950 |
| 20 | 951-1000 |

FIG. 14A

140

| Game Symbol | Selection Probability | Random Number Range |
|---|---|---|
| 9 | 20% | 1-200 |
| 10 | 20% | 201-400 |
| J | 10% | 401-500 |
| Q | 10% | 501-600 |
| K | 10% | 601-700 |
| A | 10% | 701-800 |
| PicA | 5% | 801-850 |
| PicB | 5% | 851-900 |
| PicC | 5% | 901-950 |
| PicD | 5% | 951-1000 |

FIG. 14B

132

| First Wheel | | Second Wheel | | Third Wheel | | Fourth Wheel | |
|---|---|---|---|---|---|---|---|
| Stop Position | Symbol | Stop Position | Symbol | Stop Position | Symbol | Stop Position | Symbol |
| 0 | ARROW | 0 | ARROW | 0 | ARROW | 0 | SUPREME |
| 1 | 500 | 1 | MEGA | 1 | 1000 | | |
| 2 | ARROW | 2 | ARROW | 2 | MEGA | | |
| 3 | MAJOR | 3 | 300 | 3 | 300 | | |
| 4 | ARROW | 4 | ARROW | 4 | 250 | | |
| 5 | 300 | 5 | 750 | 5 | MAXI | | |
| 6 | ARROW | 6 | ARROW | 6 | 500 | | |
| 7 | 250 | 7 | 250 | 7 | 750 | | |
| 8 | ARROW | 8 | ARROW | | | | |
| 9 | 500 | 9 | MAJOR | | | | |
| 10 | ARROW | 10 | ARROW | | | | |
| 11 | MINI | 11 | 500 | | | | |
| 12 | 250 | | | | | | |
| 13 | ARROW | | | | | | |
| 14 | 300 | | | | | | |
| 15 | 750 | | | | | | |

FIG. 15A

134

| First Wheel | | Second Wheel | | Third Wheel | | Fourth Wheel | |
|---|---|---|---|---|---|---|---|
| Stop Position | Random Number Range | Stop Position | Random Number Range | Stop Position | Random Number Range | Stop Position | Random Number Range |
| 0 | 1-25 | 0 | 1-25 | 0 | 1-25 | 0 | 1 |
| 1 | 26-50 | 1 | 26-50 | 1 | 26-50 | | |
| 2 | 51-75 | 2 | 51-75 | 2 | 51-75 | | |
| 3 | 76-100 | 3 | 76-100 | 3 | 76-100 | | |
| 4 | 101-125 | 4 | 101-125 | 4 | 101-125 | | |
| 5 | 126-150 | 5 | 126-150 | 5 | 126-150 | | |
| 6 | 151-175 | 6 | 151-175 | 6 | 151-175 | | |
| 7 | 176-200 | 7 | 176-200 | 7 | 176-200 | | |
| 8 | 201-225 | 8 | 201-225 | | | | |
| 9 | 226-250 | 9 | 226-250 | | | | |
| 10 | 251-275 | 10 | 251-275 | | | | |
| 11 | 276-300 | 11 | 276-300 | | | | |
| 12 | 301-325 | | | | | | |
| 13 | 326-350 | | | | | | |
| 14 | 351-375 | | | | | | |
| 15 | 376-400 | | | | | | |

FIG. 15B

| | Reset Amounts | | | | | | | | |
|---|---|---|---|---|---|---|---|---|---|
| | $0.01 | $0.02 | $0.05 | $0.10 | $0.25 | $0.50 | $1.00 | $2.00 | $5.00 |
| SUPREME | $5,000.00 | $10,000.00 | $25,000.00 | $50,000.00 | $125,000.00 | $250,000.00 | $500,000.00 | $1,000,000.00 | $2,500,000.00 |
| [illegible] | $500.00 | $1,000.00 | $2,500.00 | $5,000.00 | $12,500.00 | $25,000.00 | $50,000.00 | $100,000.00 | $250,000.00 |
| MEGA | $200.00 | $400.00 | $1,000.00 | $2,000.00 | $5,000.00 | $10,000.00 | $20,000.00 | $40,000.00 | $100,000.00 |
| MAJOR | $50.00 | $100.00 | $250.00 | $500.00 | $1,250.00 | $2,500.00 | $5,000.00 | $10,000.00 | $25,000.00 |
| MINI | $20.00 | $40.00 | $100.00 | $200.00 | $500.00 | $1,000.00 | $2,000.00 | $4,000.00 | $10,000.00 |

FIG. 24

| Wheel 1 | Wheel 2 | Wheel 3 |
|---|---|---|
| 750 | 750 | 1000 |
| 500 | 500 | 750 |
| 300 | 300 | 500 |
| 250 | 250 | 300 |
| | | 250 |

FIG. 25

| | Recommended Increment Rate % |
|---|---|
| SUPREME | 0.2900% |
| MAXI | 0.3500% |
| MEGA | 0.4000% |
| MAJOR | 0.4500% |
| MINI | 0.5000% |
| TOTAL | 1.9900% |

FIG. 26

| Initial Wheel Layout | 2nd Wheel Layout | 3rd Wheel Layout | 4th Wheel Layout (CENTER) |
|---|---|---|---|
| ARROW | ARROW | ARROW | **SUPREME** |
| 500 | MEGA | 1000 | |
| ARROW | ARROW | MEGA | |
| MAJOR | 300 | 300 | |
| ARROW | ARROW | 250 | |
| 300 | 750 | MAJOR | |
| ARROW | ARROW | 500 | |
| 250 | 250 | 750 | |
| ARROW | ARROW | | |
| 500 | MAJOR | | |
| ARROW | ARROW | | |
| MINI | 500 | | |
| 250 | | | |
| ARROW | | | |
| 300 | | | |
| 750 | | | |

FIG. 27

GAMING MACHINE, CONTROL METHOD FOR A GAMING MACHINE, AND PROGRAM FOR GAMING MACHINE

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine for providing a game feature to a player. The gaming machine includes an operation unit, a display unit, a memory device and a game control unit. The operation unit is configured to receive an operation input of the player. The display unit is configured to display a game screen including computer generated graphics. The memory device stores a game execution program including computer instructions for generating the game feature. The game control unit executes the game execution program to provide the game feature and is coupled to the operation unit, the display unit and the memory device. The game control unit includes a processor programmed to display a game feature structure on the game screen on the display unit. The game feature structure includes a wheel having a plurality of wedges. Each wedge has an associated indicia. The indicia are from a set of indicia which includes a plurality of prize symbols. The processor is further programmed to receive the operation input from the player through the operation unit. The operation input is indicative of a wager made by the player. The processor is programmed to establish a number of pointers as a function of the wager made by the player. The number of pointers is directly related to the wager. The processor is further programmed to display the wedges and associated indicia on the wheel; associate the established number of pointers with the wheel; display the selected number of pointers on the game screen; and independently spin and stop the selected number of pointers about the wheel. Each pointer is associated with one of the wedges of the wheel when the selected number of pointers stop.

In another aspect of the present invention, one or more non-transitory computer-readable storage media, having computer-executable instructions embodied thereon is provided. When executed by a processor, the computer-executable instructions cause the processor to display a game screen including computer-generated graphics. The processor receives an operation input of a player on an operation unit, stores a game execution program including computer instructions for generating the game feature on a memory device, and displays a game feature structure on the game screen on the display unit. The game feature structure includes a wheel having a plurality of wedges. Each wedge has an associated indicia. The indicia are from a set of indicia including a plurality of prize symbols. The processor receives the operation input from the player through the operation unit. The operation input is indicative of a wager made by the player. The processor establishes a number of pointers as a function of the wager made by the player. The number of pointers is directly related to the wager. The processor displays the wedges and associated indicia on the wheel, associates the established number of pointers with the wheel, displays the selected number of pointers on the game screen, and independently spins and stops the selected number of pointers about the wheel. Each pointer is associated with one of the wedges of the wheel when the selected number of pointers stop.

In still another aspect of the present invention, a mobile computing device is provided. The mobile computing device includes a touch display unit, a memory device, and a processor. The touch display unit is configured to display a game screen including computer generated graphics. The memory device stores a game execution program including computer instructions for generating the game feature. The game control unit executes the game execution program to provide the game feature. The game control unit us coupled to the touch display unit and the memory device and includes a processor programmed to display a game feature structure on the game screen on the touch display unit. The game feature structure includes a wheel having a plurality of wedges. Each wedge has an associated indicia. The indicia are from a set of indicia including a plurality of prize symbols. The processor allows the player to establish a wager using the touch display unit and receives a responsive signal from the touch display unit indicative of the wager. The processor establishes a number of pointers as a function of the wager made by the player. The number of pointers is directly related to the wager. The processor displays the wedges and associated indicia on the wheel, associates the established number of pointers with the wheel, display the selected number of pointers on the game screen, and independently spins and stops the selected number of pointers about the wheel. Each pointer is associated with one of the wedges of the wheel when the selected number of pointers stop.

BRIEF DESCRIPTION OF DRAWINGS

FIG. 4 is an illustration of exemplary virtual reel strips with symbol arrangements showing the order of symbols displayed on the display area, according to an embodiment of the present invention.

FIGS. 13, 14A-14B and 15A-B are exemplary illustrations of computer program data files that may be used by the gaming machine shown in FIGS. 1A-1B and the server system shown in FIGS. 11 and 12, according to embodiments of the present invention.

FIGS. 24-27 are exemplary illustrations of computer program data files that may be used by the gaming machine shown in FIGS. 1A-1B and the server system shown in FIGS. 11 and 12, according to embodiments of the present invention.

Corresponding reference characters indicate corresponding parts throughout the drawings.

DETAILED DESCRIPTION OF EMBODIMENTS

Figure 1A:
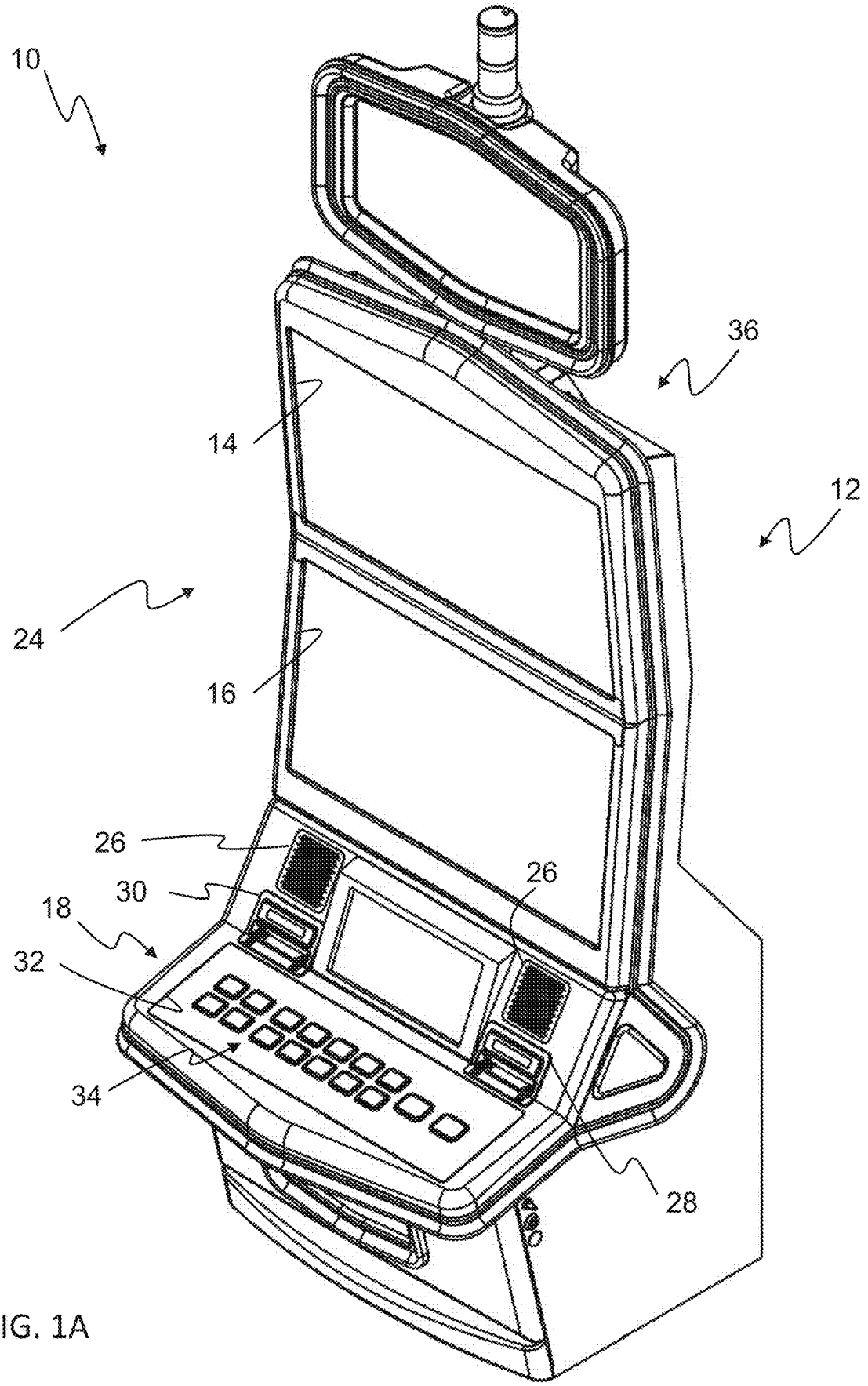
FIG. 1A is a perspective view of the gaming machine, according to the first embodiment.

A gaming machine, according to an embodiment of the present invention, referencing the attached figures is described in detail below. Further, duplicated descriptions will be omitted for identical attached symbols in identical or corresponding parts in each figure. With reference to the drawings, and in operation, the present invention is directed towards a gaming machine, a control method for a gaming machine, and a program for a gaming machine and/or mobile computing device that provides a game feature to a player. In one aspect of the present invention, the gaming machine may provide a primary game. The game feature may be provided as a game feature provided during or by primary game or the game feature may be provided as a bonus game triggered during the primary game. In an alternative embodiment, the game feature may be provided as a stand-alone or independent game.

The present invention improves the functionality of existing gaming machines by providing a game execution program including computer instructions executed by a processor to operate a game that may include a primary game and/or game feature that displays a game feature structure on a game screen on a display unit (see below). As discussed in detail below, the game feature structure includes at least one wheel with a plurality of wedges. Each wedge has an associated indicia. The indicia are from a set of indicia that includes a plurality of prize symbols. The player is allowed to place a wager. A number of pointers are established as a function of the wager. The pointers are spun about the wheel and then stopped at random position about the wheel. When in a stopped position, the pointers are associated with one of the wedges of the wheel. The player is awarded the prizes associated with the indicia of the associated wedges. The correspondence between the wager and the number of pointers increases the flexibility of providing prizes, e.g., credits, to players during the game feature and increases the player's interest in playing the game.

In one embodiment, the game feature, which may be referred to as the Power Boost Inferno™ game feature, is provided as a feature or bonus game to a primary game. The Power Boost Inferno game features allows the player to bet a primary game wager and then allows the payer to make an additional wager to be eligible for the game feature. In one embodiment, the player must make an additional wager. However, the player may choose the amount of the additional wager. As discussed in further detail below, the number of pointers used in the game feature are based on the size or amount of the additional wager. In another embodiment, the additional wager is optional.

In one aspect of the present invention, the game feature may be triggered during the primary game. In one embodiment the game feature is triggered with the appearance of a predetermined number of symbols in an outcome of the primary game (see below). In another embodiment, the trigger of the game feature may be a mystery trigger. For instance, a portion of each additional wager may be added to one or more pools. In one embodiment, the game feature may be triggered when the amount in one of the pools exceeds a predetermined or random threshold. In general, the game feature will be provided to the player whose contribution to the pool caused the pool to exceed the threshold. The trigger may be any suitable triggering condition.

With reference to FIGS. 1A-12 a gaming machine, system and mobile computing device for providing a primary game and/or the game feature in one embodiment of the present invention are shown.

Figure 1B:
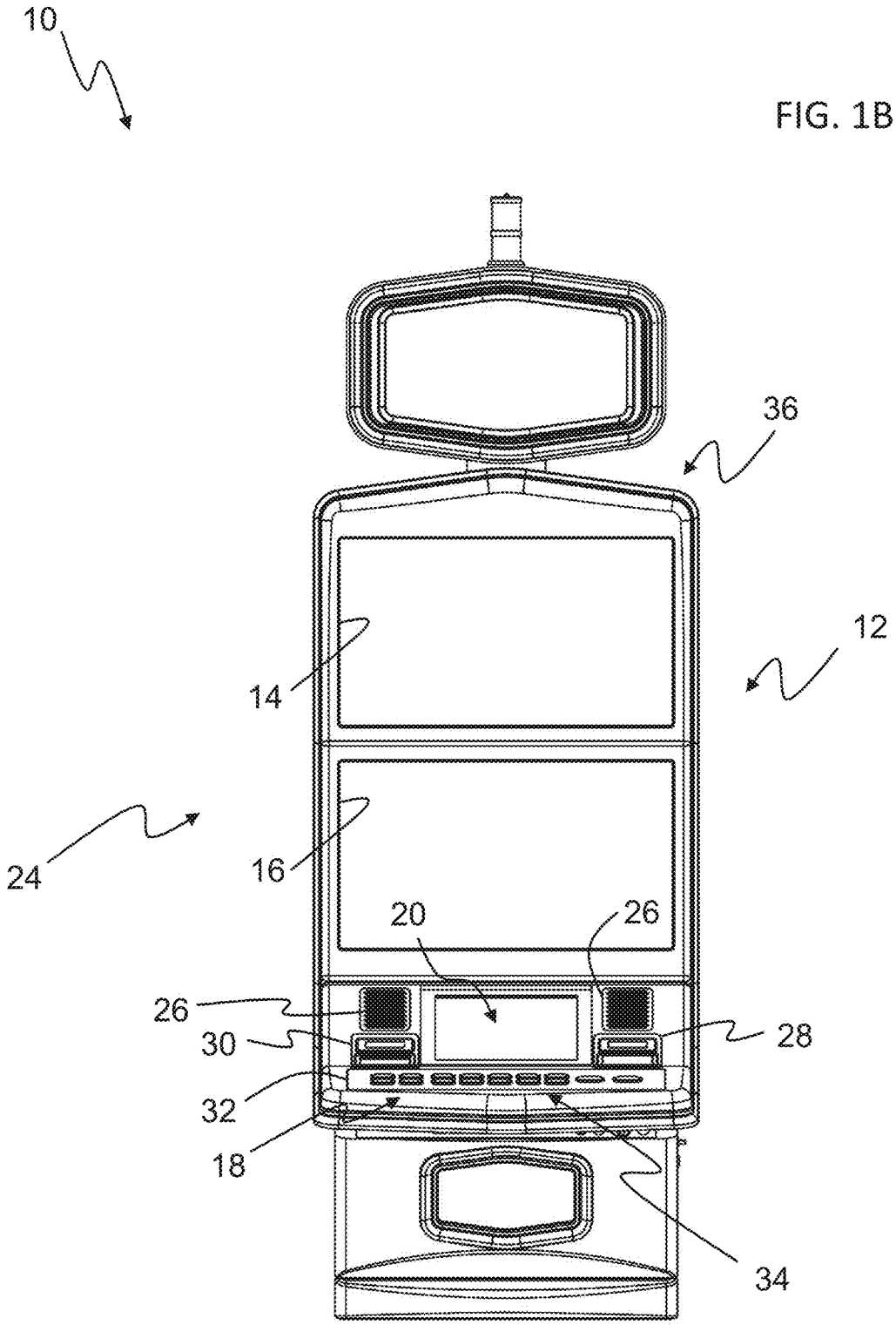
FIG. 1B is a front view of the gaming machine of FIG. 1A.

The gaming machine according to the present embodiment, receives a predetermined game value from the player, generates a game result, and provides a payout to the player according to the game result and one or more pay tables. FIG. 1A and FIG. 1B are a perspective view and a front view, respectively, of a gaming machine 10, according to the present embodiment. As shown in FIGS. 1A and 1B, this gaming machine 10 provides a cabinet 12 providing an upper display 14, a lower display 16, and a control panel 18 and may also house a player tracking or ranking unit 20. The cabinet 12 also houses a game control unit 22 (see FIG. 2) that controls each part (see below). The control unit 22 also implements a random number generator (RNG) that is used during operation of the game. Each configuration is described below.

The upper display 14 and the lower display 16 may be flat panel display devices, such as both liquid crystal display devices and organic EL display devices and the like, and by controlling via each control unit 22, the display area mentioned below functions as a display unit 24 provided to the player.

Speakers 26 are provided on the left and right of the cabinet 12, and by controlling via the control unit 22, sound is provided to the player. On the control panel 18, a bill/ticket identification device 28, a printer device 30, and an operation unit 32 are provided.

The player tracking unit 20 may be housed on the center of the front surface of the cabinet 12 below the lower display 16. The player tracking unit 20 has a card reader that recognizes a player identification card, a display that presents data to the player, and a keypad that receives input by the player. This type of player tracking unit 20 reads information recorded on the player identification card inserted by the player into the card reader, and displays the information and/or information acquired by communicating with the external system on the display, by cooperatively operating with the control unit 22 mentioned below or an external system. Further, input from the player is received by the keypad, the display is changed according to the input, and communication with the external system is carried out as necessary.

The bill/ticket identification device 28 is disposed on the control panel 18 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification device 28, receives and identifies bills/tickets (including vouchers and coupons) that are the game value as a game executing value, and notifies the control unit 22 mentioned below.

The printer device 30 is disposed on the control panel 18 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer device 30, under the control of the control unit 22 mentioned below, prints information on paper and outputs a ticket according to credit payout processing from the gaming machine 10. The output ticket can use the payout credit as game play by being inserted into the bill/ticket identification device 28 of another gaming machine, or, can be exchanged for cash by a kiosk terminal inside of the casino or a casino cage.

The operation unit 32 receives the operation of the player. The operation unit 32 includes a group of buttons 34 that receives various instructions from the player on the gaming machine 10. The operation unit 32, for example, may include a spin button and a group of setting buttons. The spin button receives an instruction to start (start rotating the reel) an instance of the game. The group of setting buttons 34 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line subjected to a line judgment below from the player. The max bet button receives an instruction operation regarding the bet of the maximum amount of credits that can be bet at one time from the player. The payout button receives an instruction operation instructing a credit payout accumulated in the gaming machine 10. The gaming machine 10 also includes illumination devices 36 that provides decorative lighting to the gaming machine 10.

In one embodiment, referring to FIGS. 1A and 1B, the control panel 18 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 24 and/or the player tracking unit 20, the paper money/ticket identification device 28, the operation unit 32, the player tracking unit 20, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein.

For example, in one embodiment, the coin slot may include an opening that is configured to receive coins and/or tokens deposited by the player into the gaming machine 10. The control unit 22 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

Figure 2:
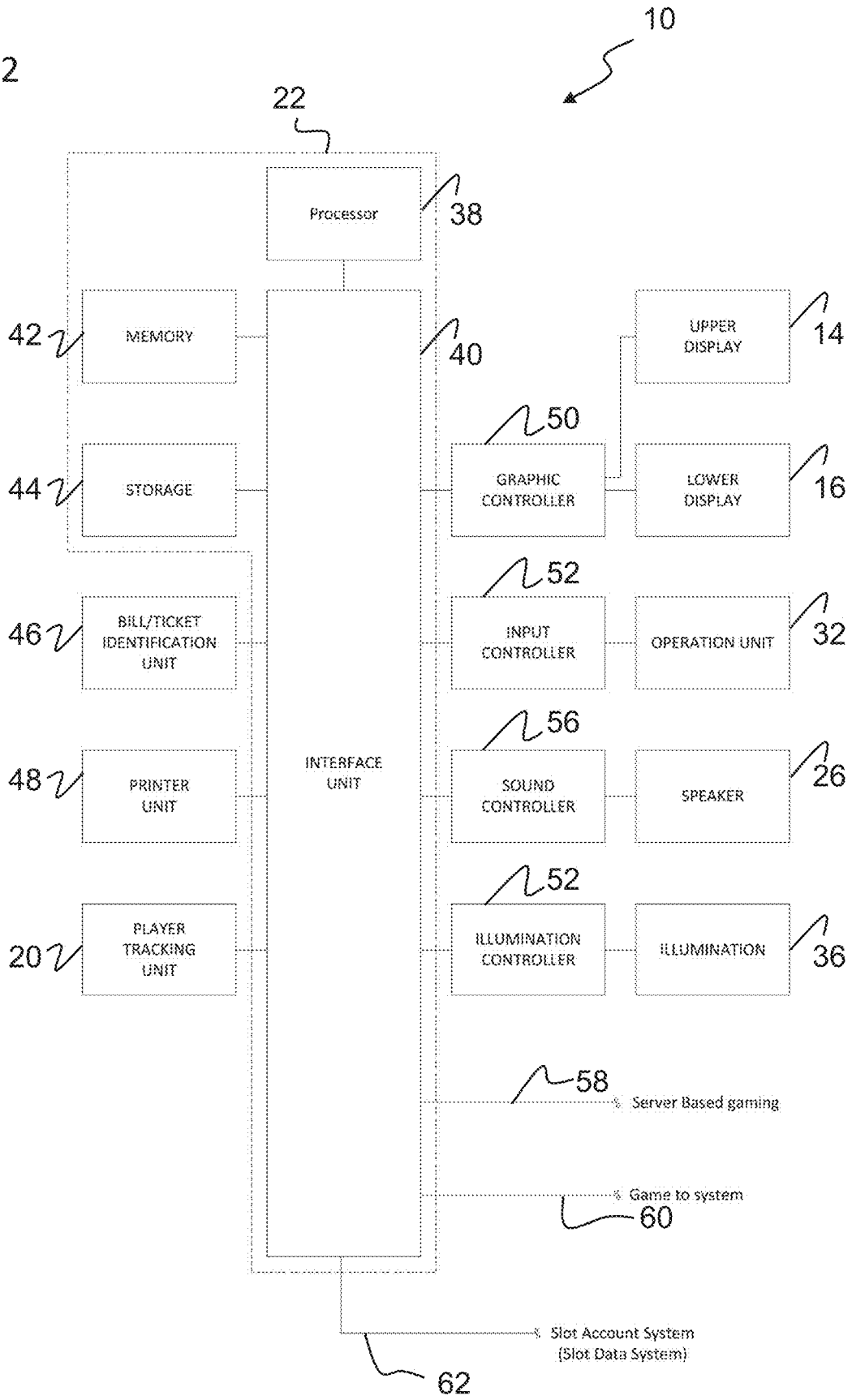
FIG. 2 is a functional block diagram of the gaming machine in FIG. 1A.

With reference to FIGS. 1A, 1B, and 2, further on the inside of cabinet 12, a control board equipped with a central processing unit 38 (abbreviated as CPU below) including a processor that configures the control unit 22, an interface unit (or part) 40, a memory 42 and a storage 44 and the like are incorporated. The control board is configured so that communication is possible through the interface unit 40 and each of the components equipped on the cabinet 12, controls the operation of each part by executing the program recorded in the memory 42 or the storage 44 of the CPU 38, and provides a game to the player. The function of the CPU 38 is to execute and display the game on the displays 14, 16 of the gaming machine 10.

FIG. 2 shows a functional block diagram of the gaming machine 10, according to the present embodiment. The gaming machine 10 provides the control unit 22. The control unit 22 is configured as the interface unit 40 including a chip set providing communication functions of the CPU 38, a memory bus connected to a CPU 38, various expanding buses, serial interfaces, USB interfaces, Ethernet (registered trademark) interfaces and the like, and a computer unit where the CPU 38 provides the addressable memory 42 and the storage 44 through the interface unit 40. The memory 42 can be configured to include RAM that is a volatile storage medium, ROM that is a nonvolatile storage medium, and EEPROM that is a rewritable nonvolatile storage medium. The storage 44 provides the control unit 22 as an external storage device function, can use reading devices such as a memory card that is a removable storage medium, and a magneto optical disk and the like, and can use hard disks.

On the interface unit 40, in addition to the CPU 38, the memory 42, and the storage 44, a bill/ticket identification unit controller 46, a printer unit controller 48, the player tracking unit 20, a graphic controller 50, an input controller 52, and a sound controller 54 are connected. That is, the control unit 22 is connected to the operation unit 32 through the input controller 52, and connected to the upper display 14 and/or the lower display 16 through the graphic controller 50. Further, when illumination devices 36 that provides decorative lighting to the gaming machine 10 is provided, the illumination is controlled under the control of the control unit 22 on the interface unit 40, and an illumination controller 56 that controls the illumination devices 36 to provide a decorative lighting effect may be connected.

The control unit 22, which includes memory 42 and storage 44, controls each part by executing a program stored in the memory 42 and the storage 44, and provides a game to the player. Here, for example, the memory 42 and storage 44 may be configured to store a program and data of an operating system and subsystem that provide the basic functions of the control unit 22 to the EEPROM of the memory 42, and stores a program and data of an application that provides a game to the storage 44. According to such a configuration, it can be easy to change or update a game by replacing the storage 44. Further, the control unit 22 may be a multiprocessor configuration that has a plurality of CPUs.

Each block connected to the control unit 22 is described below. The bill/ticket identification unit controller 46 operates the bill/ticket identification device 28 to receive bills/tickets in the insertion opening, and notifies the control unit 22 of identifying information corresponding to the assortment of bills or the payout processing of credits. The bill/ticket identification unit controller 46 notifies the information to the control unit 22, and the control unit 22 increases the usable credit amount inside of the game according to the notified content. The printer unit controller 48 corresponds to the printer device 30, and under the control of the control unit 22 that receives an operation of the payout button of the group of setting buttons 34, information corresponding to the credit payout processing from the gaming machine 10 is printed and output on a printed ticket.

The player ranking (or tracking unit) unit 20 cooperatively operates with the control unit 22, and sends and receives information and the like of the player from the casino management system. The graphic controller 50 controls the upper display 14 and the lower display 16, under the control of the control unit 22, and displays a display image that includes various graphic data. The sound controller 54 drives the speakers 26 under the control of the control unit 22, and provides various sounds such as an announcement, sound effects, BGM and the like.

Further, the interface unit 40, has various communication interfaces for communicating with the exterior of the gaming machine 10, for example the interface unit 40 can communicate with an external network by Ethernet 58, 60, and an external slot information system or slot account system 62. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3:
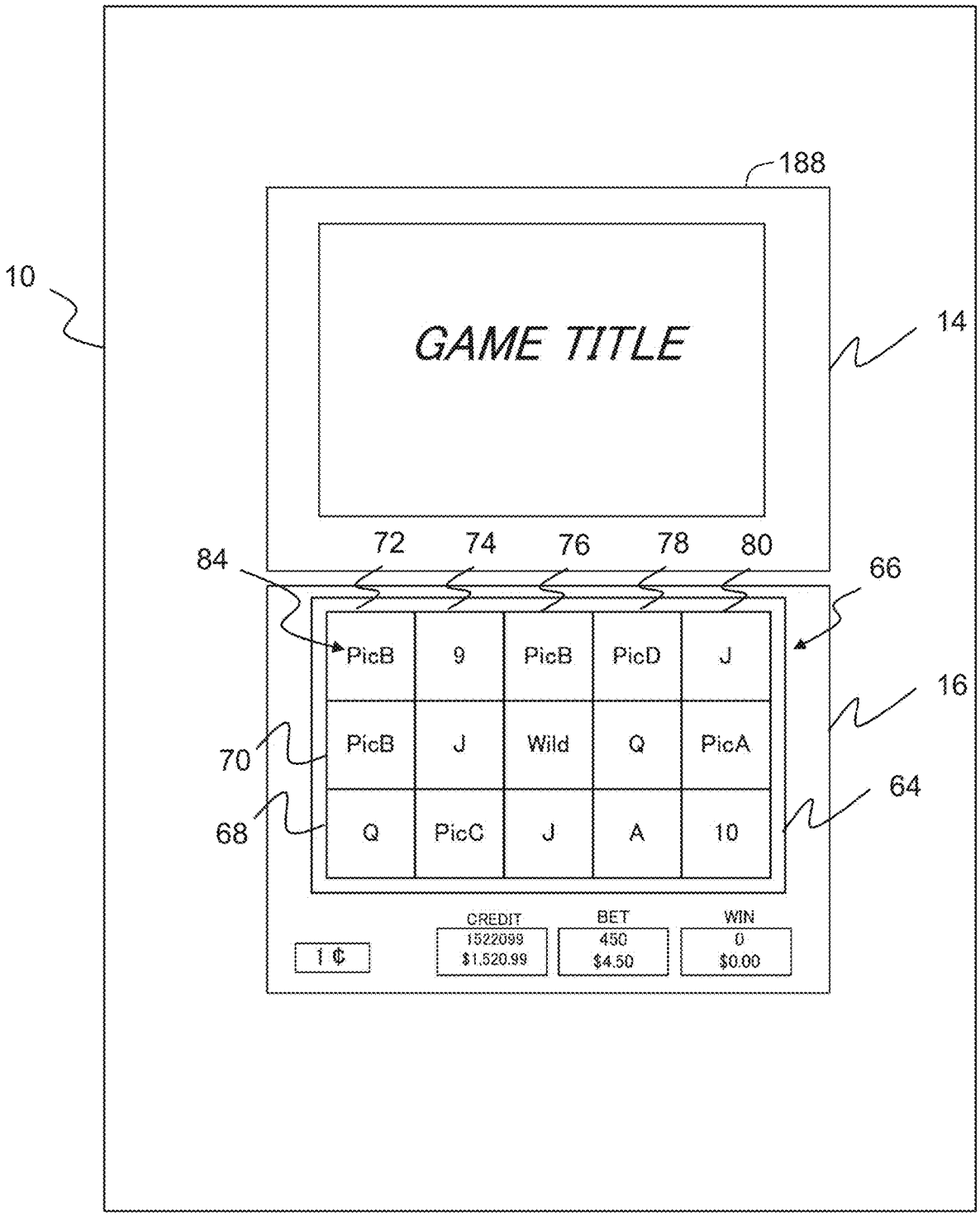
FIG. 3 is a first diagrammatic illustration of a display area of the gaming machine in FIGS. 1A-2, according to an embodiment of the present invention.

FIG. 3 schematically shows a display area 64 provided by the gaming machine 10. Such a display area 64 is displayed on the display unit 24 (the upper display 14 and/or the lower display 16) by the control unit 22 executing a predetermined program. In the illustrated embodiment, the display area 64 is displayed on the lower display 16. For instance, as shown, during a game, the upper display 14 may be utilized to display game related information, e.g., game title information and/or graphics.

As discussed above, in one aspect of the present invention, the gaming machine 10 provides a primary game. In one embodiment the primary game is a video slot game using a plurality of virtual reels 66. The video slot game utilizes a grid 68 in the display area 64. The illustrated embodiment shows the state of displaying the display area 64 in the lower display 16. As shown in FIG. 3, the display area 64 includes the grid 68 for displaying symbols. By using such a display area, the gaming machine 10 of the present embodiment operates as a slot machine that pays a payout according to a winning combination of symbols displayed on the display area 64.

The display unit 24 displays a plurality of symbols in the grid 68. The grid 68 has a plurality of rows (r) and columns (c). The grid 68 is configured by a plurality of cells 70 that are the stop position of symbols.

With reference to FIG. 3, the grid 68 may be displayed on the lower display 16. The upper display 14 may be used to display animations and/or game identifying information during the game and/or during an attract mode. Further, the display unit 24 can display a decorative area, and an area that displays credit amount, bet number, and a credit amount obtained by winning (WIN number) and the like, outside of the grid 68. On each of the plurality of cells 70 of the display area 64, one symbol is stopped and displayed.

On each cell 70 of the grid 68, as shown in FIGS. 3 and 4, a symbol is displayed based on the symbol arrangement of virtual reels 66 including virtual reel strips 72, 74, 76, 78, and 80 configured as a virtual reel set 82. That is, the cells 70 of the grid 68 correspond to the virtual reel strips 72 to 80 by column, and the symbols disposed on predetermined parts of each virtual reel strip 72 to 80 are displayed. Furthermore, by moving (scrolling or spinning) each symbol by column based on the symbol arrangement of the virtual reel strips 72 to 80, the symbols displayed in the cells 70 of the grid 68 change, and by stopping the movement (scrolling or spinning) by columns, the symbols are stopped. Here, the virtual reel strips 72 to 80 are data where the control unit 22 uses a program having the memory 42 or the storage 44, and data showing the symbol arrangement (i.e., the order of symbols on each reel strip) regulated by each cell column. Further, the virtual reel set 82 is a general term for such virtual reel strips 72 to 80.

Figure 5:
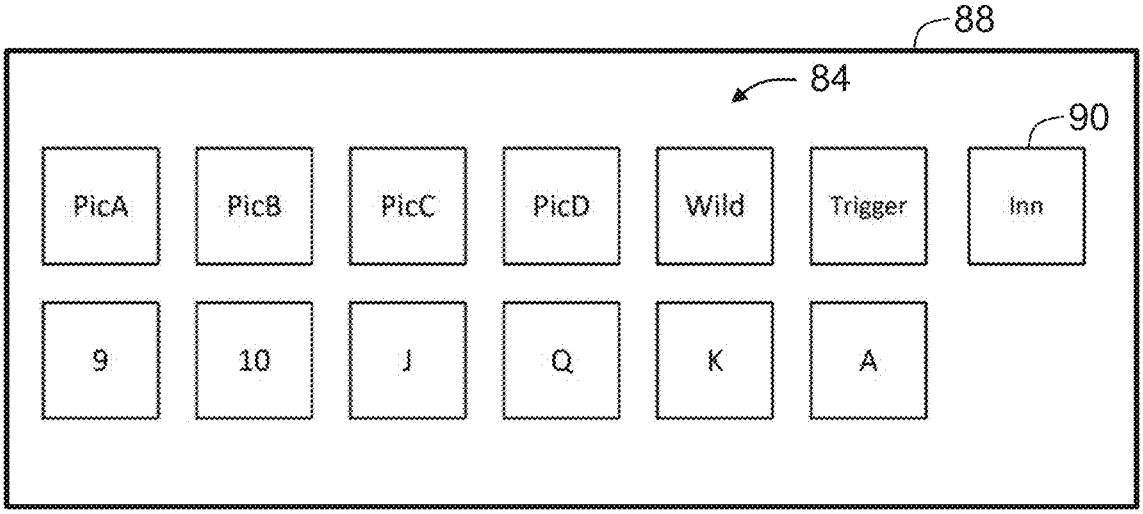
FIG. 5 is a figure showing the symbols displayed on the display area, according to an embodiment of the present invention.

Each virtual reel strip 72 to 80, in the examples of FIG. 4, may be configured by 20 symbols 84 in respective symbol positions 86, and those symbols 84 are aligned in an order defined by each reel. FIG. 5 is the details of symbols 84 of the figure shown in FIGS. 3 and 4. Each virtual reel strip 72 to 80 includes symbols selected from a symbol set 88 of varieties of symbols 84 shown in FIG. 5. This symbol set 88 includes card symbols ("9", "10", "J", "Q", "K", and "A") that imitate playing cards as regular symbols, and picture symbols ("PicA", "PicB", "PicC", and "PicD") that show a pattern. Further, this symbol set 88 includes a wild symbol ("Wild") that is substituted as another symbol when a win combination is determined and a trigger symbol ("Trigger") that may be used to determine if a game feature is to be provided. Each of these symbols have a different rank from each other regarding their value when winning, their rank gradually raises in this order: "9", "10", "J", "Q", "K", "A", "PicD", "PicC", "PicB", "PicA". A combination of symbols that includes high-ranking symbols when winning, can obtain a larger winning payout compared to a combination of low-ranking symbols when winning.

Returning to FIG. 4, in one embodiment, some of the symbol positions have a fixed symbol and others of the symbol positions have a varying symbol, represented by a varying inner symbol 90 ("inn"). In the illustrated embodiment, for each play of the game, the fixed symbol positions have an associated predefined symbol from the set of symbols 84, and the varying symbol 90 has a symbol that is randomly selected from the symbol set 88. For example, in one embodiment of the present invention, for each play of a game, one of the symbols from a sub-group of symbols included in the symbol set 88 is randomly selected and associated/displayed in the varying symbol positions 86. The sub-group may include, for example, "PicA", "PicB", "PicC", "PicD", "A", "K", "Q", "J", "10", and "9". In one embodiment, the same randomly selected symbol from the second sub-group of symbols is associated with or displayed in the varying symbol positions.

In another aspect of the present invention, all of the varying symbol positions or feature symbol positions (indicated as "inn") are arranged in groups (or stacks) of adjacent symbol positions (within a reel strip).

It should be noted that in one aspect of the present invention, one or more dynamic virtual reel strips may be utilized. Using virtual reel strips, the symbols and/or symbol positions and/or virtual reel strips and/or length or size and/or any aspect of a virtual reel strip may change from one spin or play to the next. For example, a dynamic reel strip includes a plurality of symbol positions with symbols from the symbol set 88 and a plurality of varying symbol positions ("inn"). The varying symbol positions may be in the form of one or more stacks, i.e., adjacent symbol positions. In one embodiment, the location and/or size of the stacks may change from one spin to the next, either randomly and/or in a predetermined pattern.

Alternatively, a virtual reel strip associated with a cell 70 (or column of cells 70) may be dynamically changed from one spin or play to another spin or play. This, may occur randomly, every spin or play and/or in a predetermined pattern.

It should be noted that in the illustrated embodiment, each column of the grid 68 has a corresponding reel strip. When the reel strip stops, a symbol from the respective reel strip appears in each one of the cells of the respective column of the grid 68. One or more of the reel strip 72 to 80 may be identical or all of the reel strip 72 to 80 may be different.

In an alternative embodiment, however, each cell 70 of the grid 68 has a respective independent reel that may spin independently of the other reels. Each cell 70 of the grid 68 may, thus, have an independent reel with a corresponding virtual reel strip 72 to 80. The virtual reel set 82 may include different number of virtual reel strips in such a case. For example, in an example in which a 3×5 grid is utilized, each cell 70 would have an associated virtual reel strip, so fifteen reel strips would be utilized. As above, one or more of the fifteen virtual reel strips may be identical or all reel strips may be different.

In the next several embodiments, the present invention will be described with respect to a 3×5 grid, however, it should be noted that the present invention is not limited to a grid with any specific size and/or shape.

In general, the control unit 22 starts a game and determines the stop position of each virtual reel strip 72 to 80 randomly. The virtual reel strips 72 to 80 that are displayed in the display unit 24 (for example, the lower display 16) are moved from a current position, and stopped based on a stop position to express an outcome of the game. Due to this, in the display or grid 68, the symbols included on the virtual reel strips 72 to 80 are continuously moved (scrolled or spun) in a vertical direction of the display area 64, and one symbol of one cell 70 is aligned in an order of the symbol based on the symbol arrangement is stopped so that it is displayed.

The control unit 22 changes and stops the plurality of symbols displayed on the display unit 24 according to the operation of the player received by the operation unit 32, and a payout may be paid according to the stopped symbols inside the display area 64.

In the display area 64, a pay line is set that is used when winning is determined. The pay line is set to be extended over the column on the right end from the cells of the column of the left end, and is a line that combines the plurality of cells 70 determining a win. The number of effective lines within the set pay line is selected by the operation of a group of line designation buttons included in the group of setting buttons 34 of the operation unit 32 for the player. The control unit 22, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 64 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line. In addition, more than a predetermined number of the "Trigger" form a win combination or trigger condition regardless of the pay line.

Figure 6:
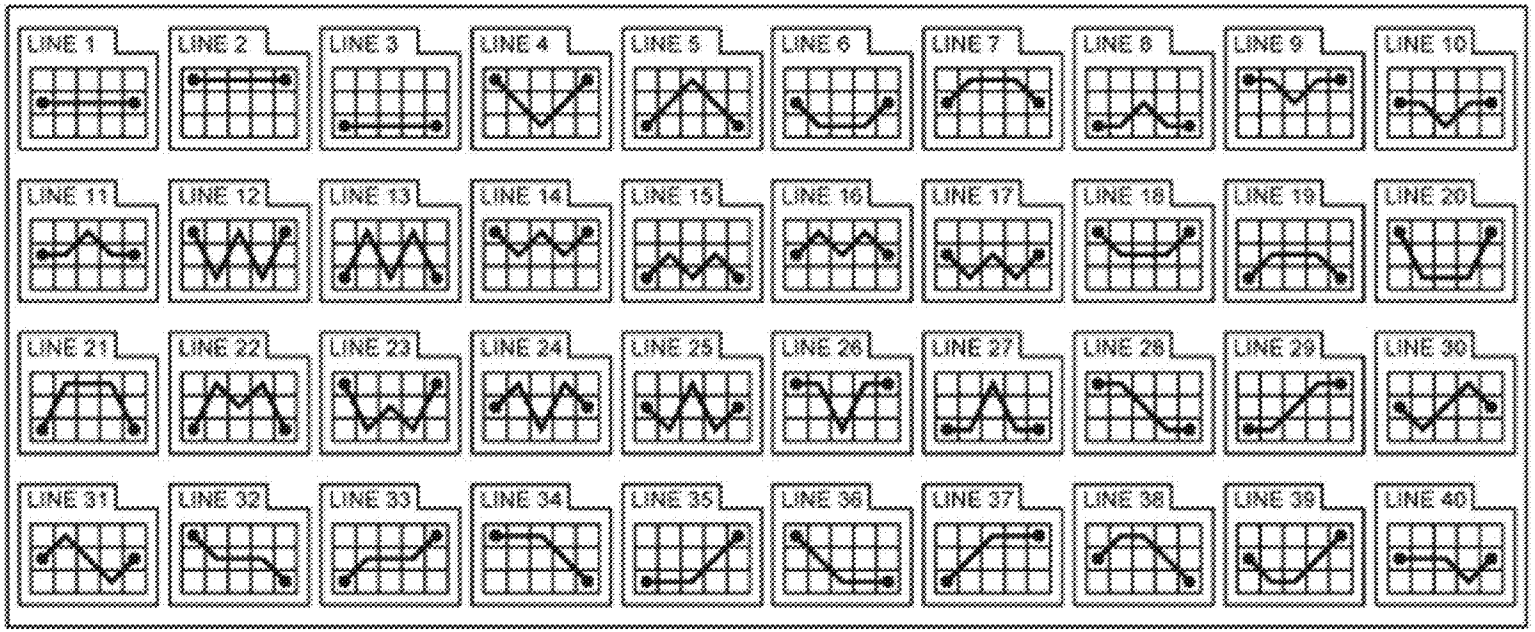
FIG. 6 is a figure showing one example of a pay line set on the determination area in FIG. 5.
Figure 7:
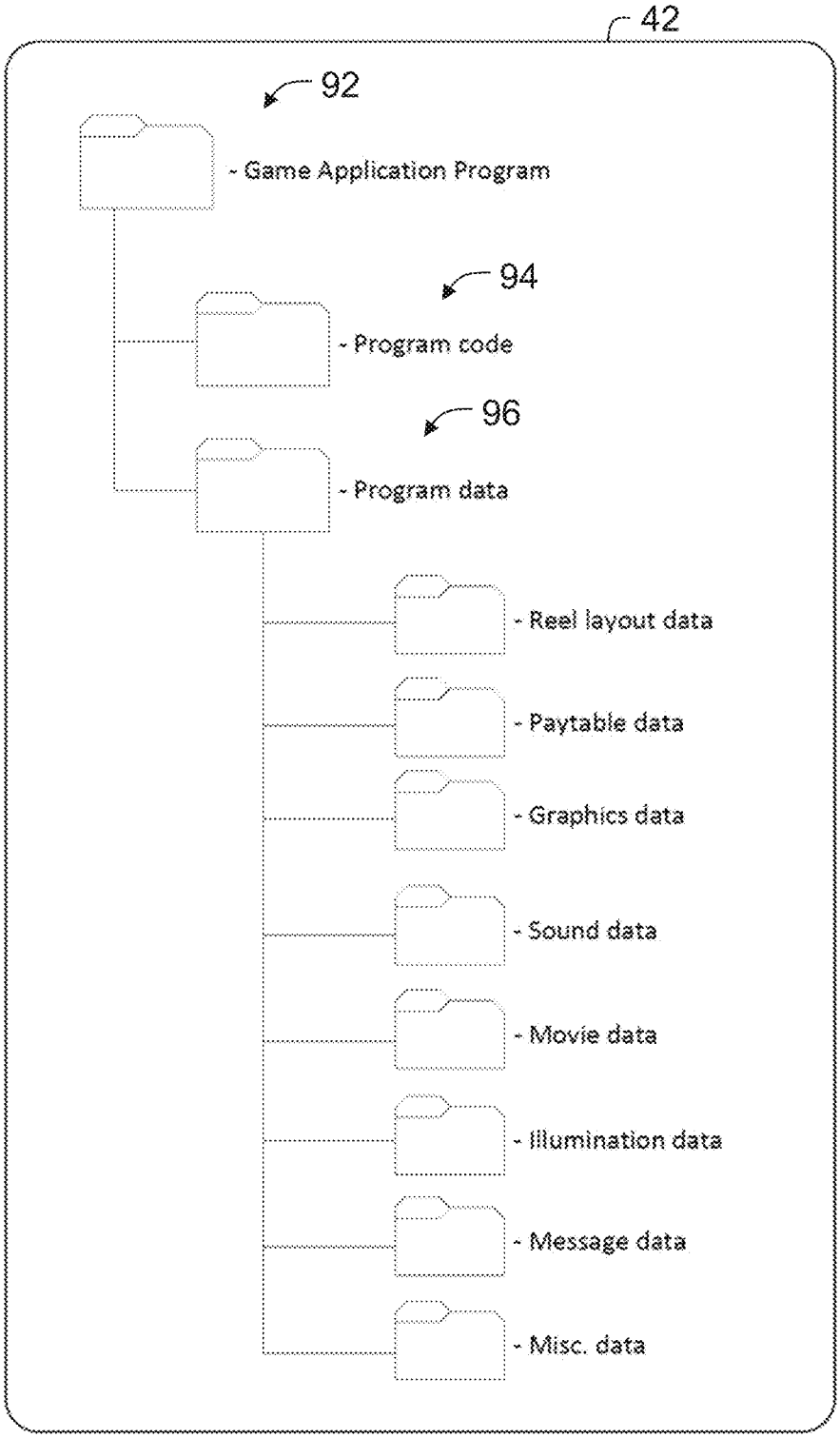
FIGS. 7-10 are block diagrams of a game control unit that may be used with to perform the function of executing a game on the gaming machine shown in FIG. 1A-2.
Figure 8:
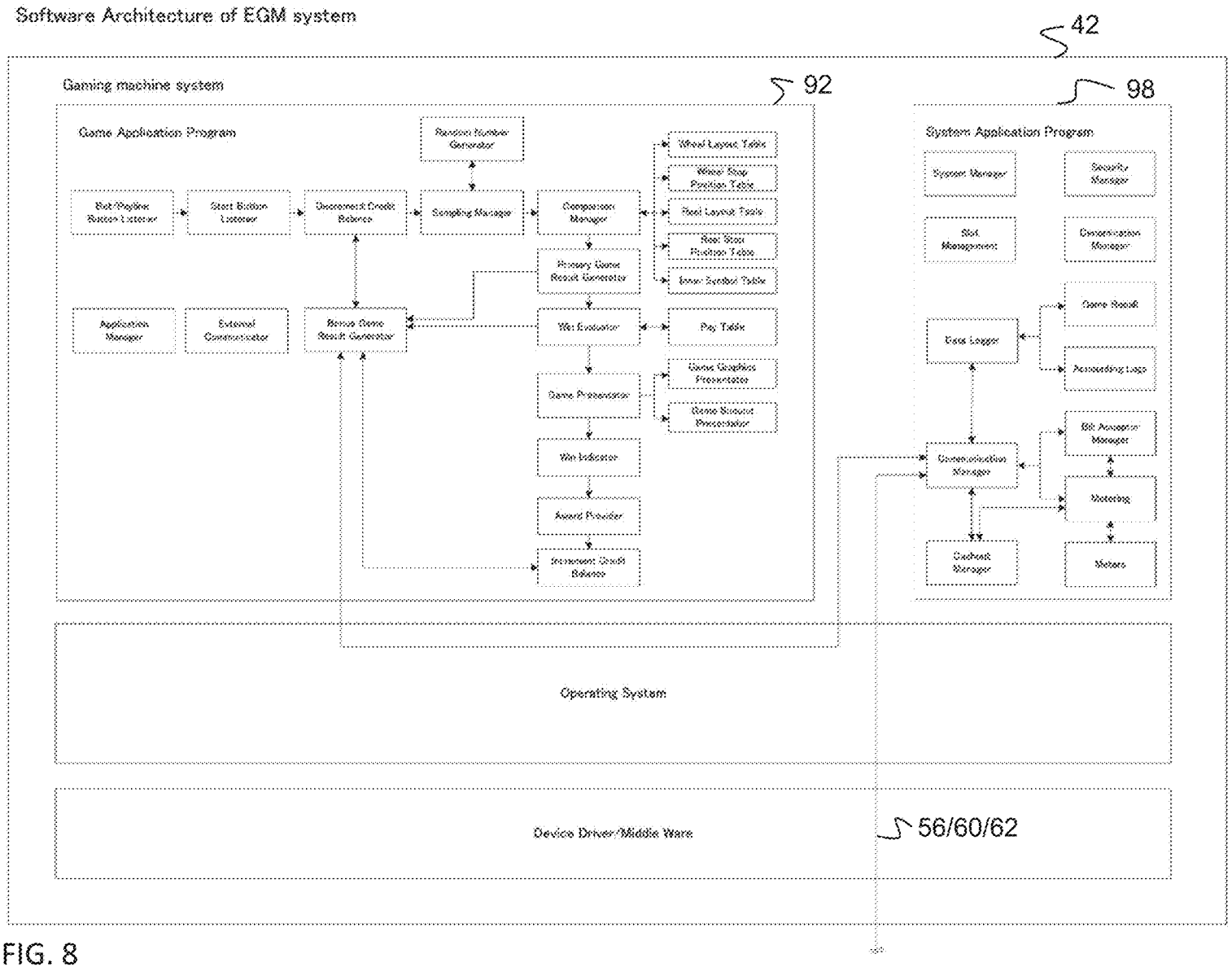
Figure 9:
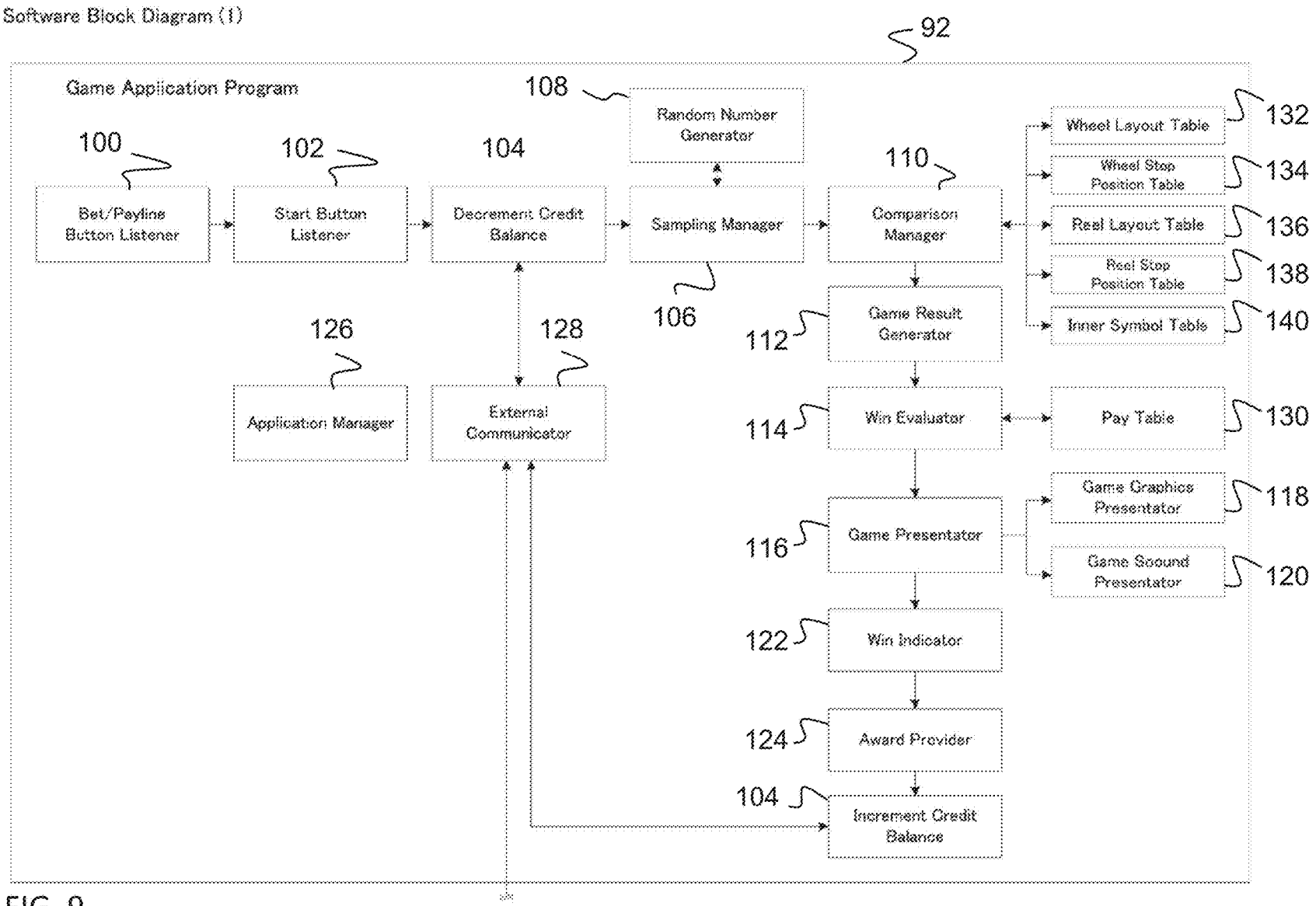
Figure 10:
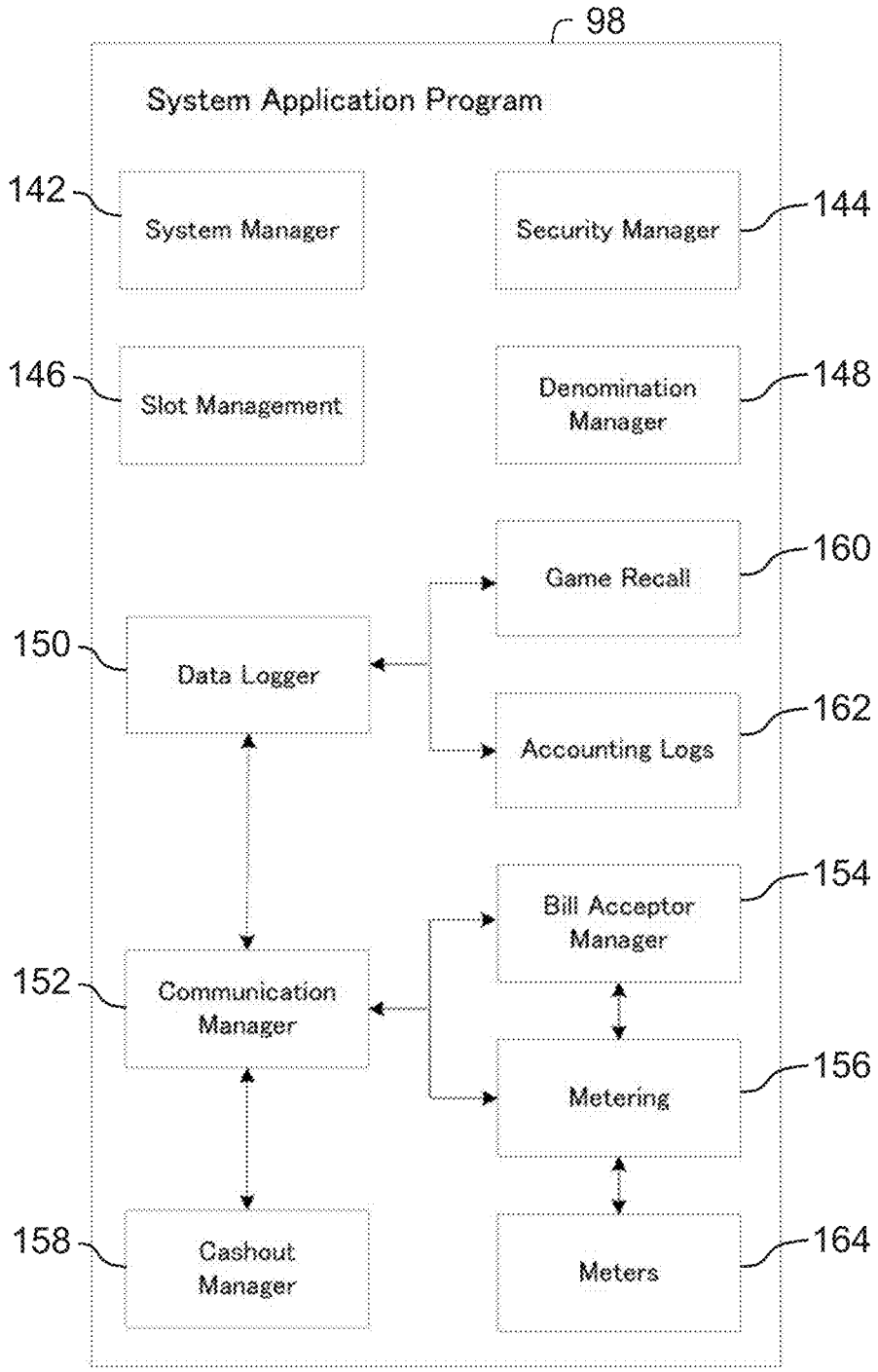

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

Referring to FIGS. 7-10, in the illustrated embodiment, the memory 42 stores a game application program 92 that includes computer executable instructions that, when executed by the processor 38, cause the processor 38 to generate and display the game on the display unit 24 of the gaming machine 10. In one embodiment, the game application program 92 includes program code 94 and program object data 96 that includes computer executable instructions for implementing a game using the algorithms shown in FIGS. 13-18.

In the illustrated embodiment, the memory 42 stores the game application program 92 and a system application program 98 that includes computer executable instructions that, when executed by the processor 38, cause the processor 38 to generate and display the game on the display unit 24 of the gaming machine 10. The application program 92 provides game specific/front-end functions and the system application program 98 provides generic/back-end functions, when executed by the processor 38. In the illustrated embodiment, the game application program 92 and the system application program 98 are implemented on the same operating system. However, it should be noted that these programs may be implemented on different operating system and/or by different processors. In one embodiment, the game application program 92 includes a plurality of software modules including a bet/payline button listener module 100, a start button listener module 102, a credit balance manager module 104 (including a decrement credit balance module and an increment balance module), a sampling manager 106, a random number generator 108, a comparison manager 110, a game result generator 112, a win evaluator 114, a game presentator 116, a game graphics presentator 118, a game sound presentator 120, a win indicator 122, an award provider 124, an application manager 126 and an external communicator 128. The game application program 92 may also include a pay table 130, a wheel layout table 132, a wheel stop position table 134, a reel layout table 136, a reel stop position table 138, and an inner symbol table 140.

The bet/payline button listener module 100 is a software module for receiving a signal from the bet button or the payline button which is generated by the button when a player operates the button to select number of bet or number of paylines. In response to receiving the signal, the bet/payline button listener module 100 communicates the occurrence of the signal to application manager 126 for changing bet or payline configuration of the game.

The start button listener module 102 is a software module for receiving a signal from the start button which is generated by the button when a player operates the button to start a game. In response to receiving the signal, the start button listener module 102 communicates the occurrence of the signal to application manager 126 for starting the game.

In response to receiving the signal from start button listener module 102, the application manager 126 requests the sampling manager 106 to obtain necessary number of random numbers from the random number generator 108.

The random number generator 108 generates random numbers based on predetermined algorithm of computational random generation method. The random number generator 108 may be a pseudorandom generator. In response to a request from sampling manager 106, the random number generator 108 returns random number. In some implementations, the random number generator 108 may be implemented in a central server. The random number generator 108 may be implemented as an integrated circuit or hard wired logic.

The comparison manager 110 compares the current state of the game or each random number with the wheel layout table 132, the wheel stop position table 134, the reel layout table 136, the reel stop position table 138 and/or the inner symbol table 140 and specifies corresponding wheel layout (game feature structure), wheel stop position, reel layout, reel stop position or inner symbol based on each random number.

The wheel layout table 132 (also shown in FIG. 15A) includes a set of symbols associated with wedges of wheels used in the game feature or bonus game as a part of a game feature structure. In this embodiment, the game feature structure includes four wheels and each wheel is associated with its layout table respectively. The game feature structure is formed based on the wheel layout table 132.

The wheel stop position table 134 (also shown in FIG. 15B) includes a random number range associated with each stop position (wedge) of each wheel. The comparison manager 110 identifies a stop position of each pointer based on corresponding random number and the wheel stop position table 134. In this embodiment, the comparison manager 110 identifies a stop position of the pointers respectively and some of the pointers may stop on the same wedge of the wheel. For example, the sampling manager 106 requests random numbers within predetermined range listed in the wheel stop position table 134 to the random number generator 108, the random number generator 108 returns requested random numbers and the comparison manager 110 determines corresponding stop positions of the pointers on the wheels. It should be noted that the random number range associated with each stop position might be different and/or weighted.

The reel layout table 136 (also shown in FIG. 13) includes a set of virtual reels strips for a primary game and a free game bonus. The comparison manager 110 inquires the application manager to identify current state of the game and select the sets of virtual reel strips.

The reel stop position table 138 (also shown in FIG. 14A) includes a random number range associated with each stop position of a virtual reel strip. The comparison manager 110 identifies a stop position of each reel based on corresponding random number and the stop position table 134. For example, the sampling manager 106 requests random numbers within predetermined range listed in the reel stop position table 136 to the random number generator 108, the random number generator 108 returns requested random numbers and the comparison manager 110 determines corresponding stop positions of the reels. It should be noted that the random number range associated with each stop position might be different and/or weighted.

The inner symbol table 140 (also shown in FIG. 14B) includes a random number range associated with each stop position of a virtual inner reel. The comparison manager 110 identifies a stop position of the virtual inner reel based on corresponding random number and the inner symbol table 138.

The game result generator 112 generates game result based on selected reel layout, stop positions of each reel, stop position of inner symbol, and bonus features.

The win evaluator 114 evaluates the game result with reference to the pay table 130.

The game presentator 116 provides game presentation process with visual and sound so as to form the predetermined game result finally.

The game graphics presentator 118 provides visual game presentation process on the display so as to form the predetermined game result finally.

The game sound presentator 120 provides sound presentation process by using sound controller and speakers.

The win indicator 122 indicates win combinations and payment condition of prize symbol formed in the game result.

The award provider 124 provides award credit to win meter based on the win evaluation.

The application manager 126 administrates activity and status of each software module. In addition, the application manager 126 administrates configuration, progress and states of the game application program 92.

The external communicator 128 communicates instruction and data with the system application program 98.

The credit balance manager module 104 executes a process for decrementing credit balance and incrementing credit balance based on win amount displayed in win meter.

The pay table 130 includes a prize associated with each win combination.

The game feature manager 131 functions to execute the game feature (as a part of the primary game, a bonus game and/or a stand-alone game) by executing the respective algorithms (see below).

In the illustrated embodiment, the system application program 98 provides back ground processing and functions other than game specific functions. The system application program 98 includes a plurality of software modules including a system manager 142, a security manager 144, a slot management module 146, a denomination manager 148, a data logger 150, a communications manager 152, a bill acceptor manager 154, a metering module 156, and a cashout manager 158.

The system application program 98 may also include a game recall file 160, accounting logs 162, and meters 164.

The system manager 142 is a software module for administrating all of the back ground processing and functions other than game specific functions conducted by the system application program 98.

The security manager 144 is a software module for administrating game verification, door security and monitoring security sensors.

The slot management module 146 is a software module for administrating data accumulation and communicating with an external slot information system or slot account system 62.

The denomination manager 148 is a software module for establishing denomination setting of the gaming machine 10. The denomination setting may include 1 cent, 2 cent, 5 cent, 25 cent, 1 dollar, 5 dollar and the like.

The data logger 150 is a software module for logging result of each primary game and the game feature (or bonus game) to the game recall. In addition, the data logger 150 stores error events, bill log, cashout log, ticket log etc. to the accounting log.

The game recall file 160 is an accumulated data including results of each primary game and free game bonus. The game recall file 160 is stored in a non-volatile memory.

The accounting logs 162 is an accumulated data including error events, bill log, cashout log, ticket log etc. The accounting logs 162 are stored in a non-volatile memory.

The communications manager 152 is a software module for administrating communication between game application program 92 and system application program 98. The communications manager 152 also administrates network communication between system application program 98 and external network such as slot management system network, G2S network, gaming server for server based gaming network or VLT system network.

The bill acceptor manager 154 is a software module for administrating the bill acceptor and receives bill information inserted in the bill acceptor. In response to receiving the information from the bill acceptor, the bill acceptor manager 154 communicates with the metering for incrementing credit balance based on the inserted bill.

The metering module 156 is a software module for adjusting values of the meters 164 in response to communication with the game application program 92 via communications manager 152, the bill acceptor manager 154 or the cashout manager 158. The meters 164 includes a credit meter for indicating current credit balance on the gaming machine and an win meter for indicating win amount of current game session. The meters further include back ground meters such as coin-in, coin-out, total drop, attendant paid jackpots and/or bill-in. In addition, the meters might further include progressive jackpot value that is incremented by a percentage of each bet placed on the gaming machine. These meters might be implemented as data on the non-volatile memory or hardware meters.

The cashout manager 158 is a software module for administrating cashout procedure. In response to a player's operation on the cashout button, the cashout manager 158 is activated and the gaming machine pay total amount of the credit meter.

Figure 11:
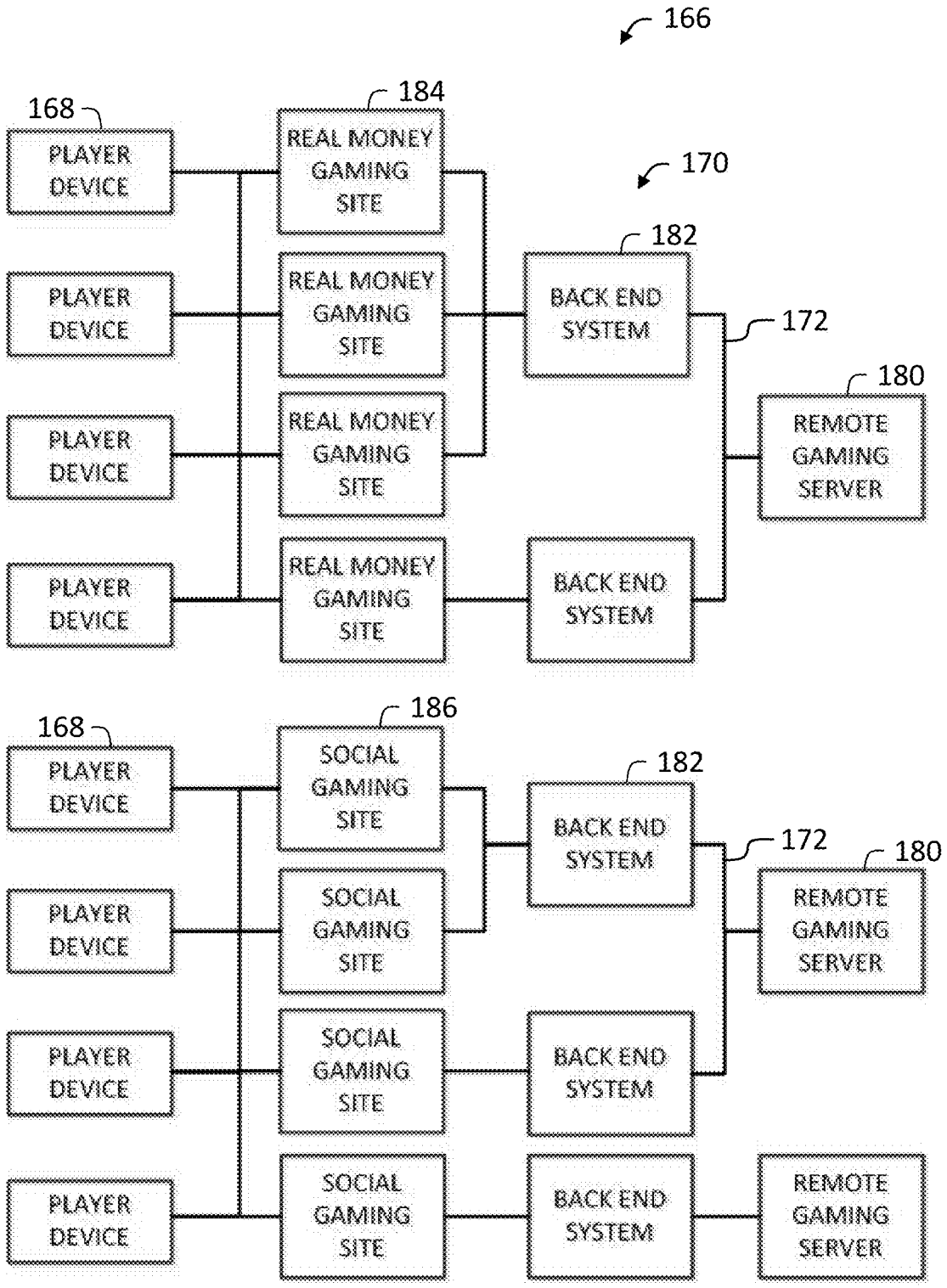
FIG. 11 is a functional block diagram of a server computer system, according to an embodiment of the present invention.
Figure 12:
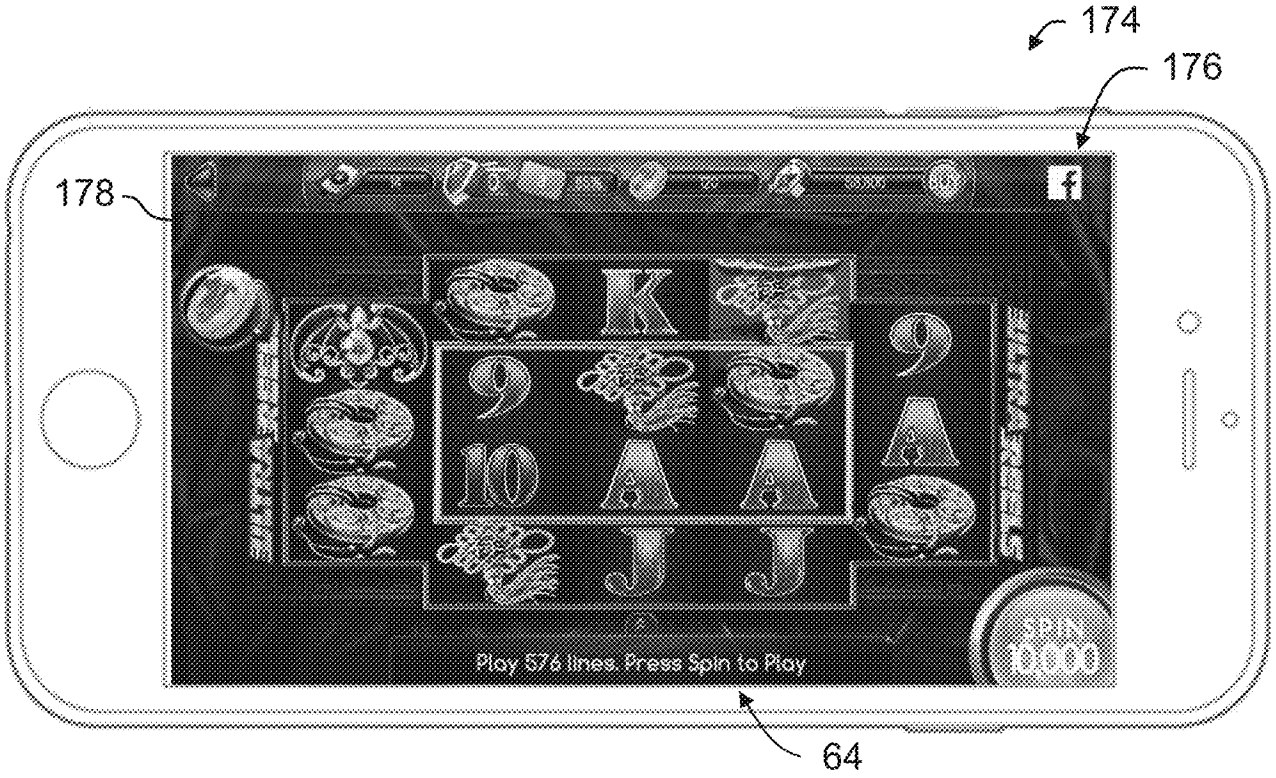
FIG. 12 is a front view of a mobile computing device that may be used with the server computer system of FIG. 11.

Referring to FIGS. 11 and 12, in one embodiment, the present inventions includes a networked server computer system 166 that is configured to deliver the game to one or more client computing devices 168 over the Internet. In the illustrated embodiment, the networked server computer system 166 includes an iGaming server system 170 that is coupled in communication with one or more client computing devices 168 via a communications network 172. The communications network 172 may be any suitable connection, including the Internet, an Intranet, LAN, a virtual private network (VPN), cellular networks, etc. . . . , and may utilize any suitable or combination of technologies including, but not limited to wired and wireless connections, always on connections, connections made periodically, and connections made as needed.

The client computing device 168 may include any suitable device that enables a user to access and communicate with the server system 170 including sending and/or receiving information to and from the server system 170 and displaying information received from the server system 170 to a user. In the illustrated embodiment, the client computing device 168 includes a processor coupled to a memory device. The memory device stores various programs and data that are executed by the processor for operating the client computing device 168. The client computing device 168 also includes an input device configured to receive operational inputs from the user, and a display device configured to display a graphical user interface. The input device and display device enable a user to interact with the server system 170 via the client computing device 168. For example, in one embodiment, the client computing device 168 may include, but is not limited to, a desktop computer, a laptop or notebook computer, a tablet computer, smartphone/tablet computer hybrid, a personal data assistant, a handheld mobile device including a cellular telephone, and the like. In one embodiment, the processor of the client computing device 168 may be programmed to function as the control unit 22 of the gaming machine 10.

In the illustrated embodiment, the client computing device may include a web browser program stored in the memory device. The processor executes the web browser program to display web pages on the display device that includes information received from the server system 170 to enable a user to interact with and operate the server system 170.

In one embodiment, the client computing device 168 includes a mobile computing device 174 (shown in FIG. 12) such as, for example, a tablet computer, a smartphone/tablet computer hybrid, a smartphone such as an iPhone™, and the like. The mobile computing device 174 includes a processor coupled to a memory device for storing various programs and data for use in operating the mobile computing device 174. The mobile computing device 174 may also include a touchscreen display unit 176, one or more video image cameras, one or more speakers, a microphone, at least one input button, and one or more sensors including, but not limited to, a touch ID fingerprint sensor coupled to an input button, a barometer, a three-axis gyro, an accelerometer, proximity sensor, and an ambient light sensor. In addition, the mobile computing device 174 may also include a Wi-Fi antenna, a cellular network antenna, a Bluetooth™ communications device, assisted GPS and GLONASS, a digital compass, and an iBeacon™ microlocation device.

The mobile computing device 174 may be programmed to store and execute mobile computer program applications that display graphical user interfaces 178 on the touchscreen display unit 176 including display area 64 that allows the user to access the server system 170 to retrieve and store information within the server system 170 as well as interact with and operate the server system 170. In addition, in one embodiment, the server system 170 may install one or more mobile computer application programs in the memory device of the mobile computing device 174. When initiated by the processor of the mobile computing device 174, the mobile computer application program causes the processor of the mobile computing device 174 to perform some or all of the functions of the gaming machine 10.

In the illustrated embodiment, the server system 170 includes one or more remote gaming servers 180, one or more back-end servers 182, one or more real money gaming website hosting servers 184, and one or more social gaming website hosting servers 186. In the illustrated embodiment, the social gaming website hosting server 186 and the real money gaming website hosting server 184 are programmed to host a website that is accessible by a user via one or more client computing devices 168. The website hosting servers 184 and 186 execute a website application program that retrieves application code from the back-end server 182 and executes the application code to render one or more webpages on a display device of a client computing device 168 in response to requests received from the user via the client computing device 168 to allow users to interact with the website. The website hosting servers 184 and 186 are configured to generate and display webpages displaying a game. For example, the real money gaming web site hosting server 184 is configured to host a real money wagering web site that enables players to convert monetary funds to gaming credits that may be used to place wagers on the game. The social gaming website hosting server 186 is configure to host a social media and/or social gaming website that allows players to receive gaming credits for activities such as purchasing goods and/or services through an e-commerce website, and/or purchase gaming credits that may be used to play the game.

Each back-end server 182 is configured to perform operations to support the functions of the webpages and/or website being displayed by the website hosting servers 184 and 186. For example, in one embodiment, the back-end servers 182 may include a player account system server that is configured to generate player accounts that include data associated with a player including, but not limited to, player identification information, player financial account information, player gaming credit account information, and/or any suitable player information, that may be used to establish credit meters and allow players to place wagers on the game.

Each remote gaming server 180 includes one or more copies of the game application program 92 stored in a memory device of the remote gaming server 180. A processor of the remote gaming server 180 is programmed to retrieve and transmit the game application program 92 to one or more back-end servers 182 for use in displaying the game to the user via a webpage being displayed by the web browser program.

In one embodiment, the game application program 92 may include instructions for rendering the game and executing the game on the client computing device 168. For example, the game application program 92 may include instructions for generating rendered code, such as, for example HTML code, that may be used by the web browser program of the client computing device 168 for displaying the game. For example, the game application program 92 may include program software code including, but not limited to, HTML, JavaScript, cascade style sheets (CSS), and any suitable programming code that may be used for rendering and operating the game via a web site and/or mobile computer application.

In one embodiment, upon receiving a request from the web site hosting servers 184, 186 via the back-end server 182, the remote gaming server 180 may execute the game application program 92 to operate the game, and execute a render-to-string operation to generate rendered code indicative of the primary game and/or game feature and/or bonus game, such as, for example HTML code, and transmit the rendered code to the back-end server 182. The back-end server 182 may then transmit the rendered code to the corresponding web site hosting servers 184, 186 for use in displaying the game on the website. As the player plays the game, the remote gaming server 180 may execute the game application program 92 for each instance of the game, and transit rendered code to the back-end servers 182.

In another embodiment, the remote gaming server 180 may transmit the game application program 92 to the back-end server 182 and/or the website hosting servers 184, 186. The back-end server 182 and/or the website hosting servers 184, 186 may then execute the game application program 92 to initiate the instances of the game and execute render-to-string operations to generate rendered code indicative of the game.

In yet another embodiment, the back-end server 182 may receive a request to initiate the game from a mobile computing device 174 executing the mobile computer application program. Upon receiving the request, the back-end server 182 may access the game application program 92 and execute a render-to-string operation to generate rendered code indicative of the game and transmit the rendered code to the mobile computing device 174. In one embodiment, the back-end server 182 may continuously execute the game application program 92 to generated each instance of the game using a random number generator of the back-end server 182 based on input received from the mobile computing device 174 and generate and transmit rendered code for each instance of the game to the mobile computing device 174. In another embodiment, the back-end server 182 may execute a partial-render operation and generate partially-rendered code of the game using the game application program 92, and transmit the partially rendered code of the game and object data of game assets to the mobile computing device 174. The partially rendered code includes instructions for generating rendered code using the game assets and a random number generator of the mobile computing device for generating and displaying the game on the mobile computing device 174 using the mobile computer application program.

In one embodiment, the game application program 92 may be stored on several different servers. The game code on these servers is used to distribute game content to social or real money gaming websites and mobile applications. The distribution method is very flexible. For example, the game code and/or game application program 92 including game code and game object assets may be stored on a remote gaming server 180. One remote gaming server 180 may be connected to one or more back-end server 182.

Each back-end server 182 is configured to distribute the games to one or more websites or mobile applications.

Players connect to these websites/mobile applications with the client devices or mobile devices and have access to the game content. A copy of game application program 92 including game code and game object assets is stored on the remote gaming server 180 for each back-end server 182 that is connected to the remote gaming server 180 and that distributes the game. For example, if one remote gaming server 180 is connected to two back-end servers 182, which is connected to three website hosting servers 184, 186 that distribute the game, the remote gaming server 180 would store two copies of the game application program 92 including game code and game object assets for the game (e.g. one copy for each back-end server 182).

For example, the server system 170 may be configured to implement the game on a mobile application such as, for example, "my KONAMI Slots™" mobile application available in Apple iOS™, Google Android™, and Amazon Kindle™ operating platforms, or on social-media websites such as the "my KONAMI Slots™" available on Facebook™. In one embodiment, the mobile application may download the game code from remote gaming server 180 via the real money gaming site 184 or the social gaming site 186 and execute the game code on the client computing device 168. In this embodiment, the game code may provide game specific/front-end function when executed by the processor of the client computing device, and the back-end server 182 may provide generic/back-end function.

FIGS. 13-19 and 20A-20B are flow charts of methods M10, M20, M30, M40, M50 illustrating the algorithms included in the game application program 92 and performed by the processor 38 when executing the game application program 92 for operating the gaming machine 10 and/or iGaming server system 170 to implement the primary game, game feature and/or bonus game. The methods include a plurality of steps. Each method step may be performed independently of, or in combination with, other method steps. Portions of the methods may be performed by any one of, or any combination of, the components of the gaming machine 10 and/or iGaming server system 170.

In the illustrated embodiment, the game application program 92 includes computer instructions for generating a primary game and/or a game feature and/or a bonus game that includes displays a game feature structure on a display unit and a number of pointers for use in the game feature. In general, the game feature provides a number of pointers for use in the game feature. In addition, the game feature provides an option to the player to select the number of pointers to be used in the game feature. In a specific embodiment, the number of pointers used in the game feature is dependent upon a wager amount made by the player.

The game feature may be provided during, or as bonus game to, a primary game. The primary game may include a reel-type game that includes a plurality of virtual reels that spin and stop to display the outcomes of the primary game. In other embodiments, the primary game may include a playing card game, a bingo game, a Keno game, and/or any suitable casino type wagering game. In alternative embodiments, the game feature is provided as stand-alone game.

Referring to FIG. 13, in the illustrated embodiment, in a first method M10, a primary game in the form of a virtual slot game is provided. In a first method step 10S1, the processor 38 displays spins the virtual reels. In a second method step 10S2, the processor 38 stops the virtual reels. In a third method step 10S3, the processor 38 evaluates the outcome of the primary game (and awards to the player any award as a function thereof). In a fourth step 10S4, the processor 38 determines if the game feature trigger has occurred. As discussed above, the game feature trigger may be the appearance of one or more predetermined symbols in the outcome of the primary game and/or a mystery trigger and/or any suitable trigger. If the game feature trigger has been detected than the method M10 proceeds to a fifth step 10S5. Otherwise, the primary game ends.

In the fifth method step 10S5, if the game feature trigger has been detected, then the game feature is provided.

As discussed above, in general, the game feature includes a game feature structure (see below) displayed on the display unit. A number of pointers are established by the processor 38 as a function of a wager made by the player. If the game feature is provided in conjunction with a primary game, the player is required to play wager on the primary game. The wager, or additional wager, for the game feature may also be required or may be optional. The number of pointers used in the game feature may be a function of the size of the additional wager.

In one embodiment, the player must wager an additional default wager, e.g., 10 credits. The default wager provides one pointer. Each additional wager of 10 credits provides an additional pointer. In a specific embodiment, the following additional wagers are provided:

10 credits (default): 1 pointer,
20 credits: 2 pointers,
30 credits: 3 pointers,
50 credits: 5 pointers, and
100 credits: 10 pointers.

It should be noted that the present invention is not limited to the above stated option; other additional wager/pointer combinations may be offered.

In general, the game feature structure includes at least one wheel with a plurality of wedges. Each wedge has an associated indicia. The indicia are from a set of indicia including a plurality of prize symbols. In one embodiment, the set of indicia includes a plurality of credit values. In another embodiment, the set of indicia includes a plurality of credit values and one or more jackpot symbols. With respect to the credit values, the prize associated with these prize symbols is equal to the associated credit value. With respect to the jackpot symbols, one or more of the jackpot symbols may be associated with a progressive jackpot. The progressive jackpots may be local progressive jackpots and/or linked progressive jackpots. One or more of the jackpots may have an associated predetermined credit value and/or other prize associated therewith.

In general, the processor 38, via the game application program, receives input from the player through the operation unit 32 that is indicative of a wager and establishes a number of pointers as a function of the wager. The game feature structure, wedges, and associated indicia are displayed on the display unit 24 by the game feature manager 131 of the game application program. The established number of pointers are displayed about the wheel, e.g., about the outer circumference of the wheel. The pointers are then independently rotated spun about the wheel and then stopped. In one embodiment a stop of location of each pointer is randomly determined. After the pointers have stopped, each pointer is associated with one of the wedges of the wheel. The player is then awarded a prize represented by, or associated with, any prize symbol on the wedges associated with the pointers.

In another embodiment, as shown in FIGS. 21A-21F, a game feature structure 200 having multiple concentric wheels is shown. With specific reference to FIG. 2A, in one embodiment, only a first, outer wheel 202A is initially shown. The outer wheel 202A has sixteen wedges as shown. Each wedge has an associated indicia. The indicia are from a set of indicia that includes a plurality of prize symbols, one or more jackpot symbols and an upgrade symbol (which is represented by a blank symbol or wedge). In the illustrated embodiment, seven of the wedges have an associated blank or upgrade indicia. The other wedges have the following indicia: 100 credits; 500 credits; 200 credits; 300 credits; Major progressive jackpot award; Mini progressive jackpot award; 1,000 credits; Mini jackpot progressive jackpot award; and 300 credits.

Once the number of pointers have been established, the pointers 204 are displayed. In the illustrated embodiment, the number of pointers 204 is eight. The pointers 204 are rotated about the outer circumference and stopped at randomly determined locations (see FIG. 21A). The randomly determined locations are associated with one of the wedges of the, outer wheel 202A. As indicated by the arrows, in one embodiment all of the pointers spin or rotate in the same direction, e.g., clockwise. It should be noted that the pointers could all spin in the opposite direction or the pointers could move in different directions.

Once the pointers are stopped, any pointer 204 associated with a wedge having an associated prize symbol, e.g., a credit amount or a jackpot is held. Any remaining pointers 204, i.e., that are not locked, are moved inward towards a second or middle wheel 202B (see FIG. 21B). In the illustrated embodiment, four of the pointers 204 are held at the first wheel 202A and are associated with the following prize symbols: 500 credits; 300 credits; Mini progressive jackpot award; and 300 credits. The remaining pointers 204 are moved inward.

Figure 21A:
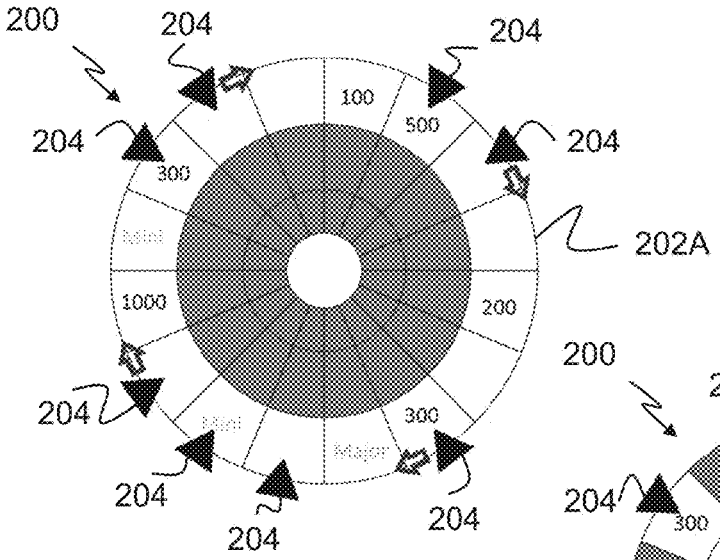
FIGS. 21A-21F are diagrammatic illustrations of a game feature structure displayed on a display unit, of the gaming machine in FIGS. 1A-1B and the mobile computer device shown in FIG. 12, during a game feature, according to an embodiment of the present invention.
Figure 21B:
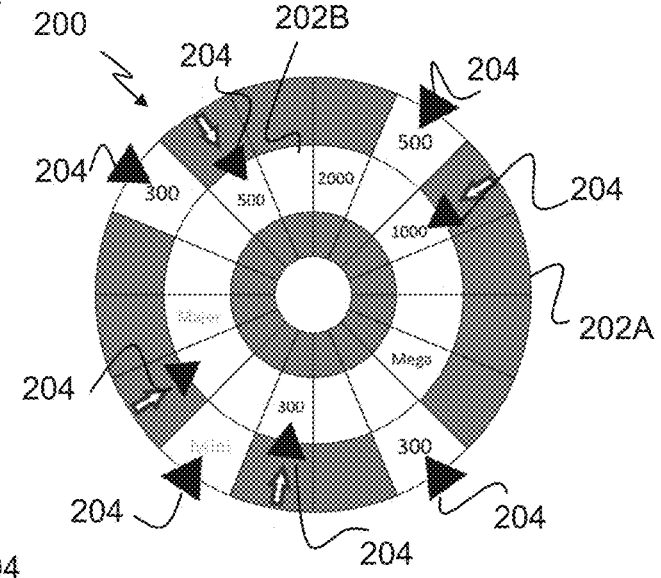
Figure 21C:
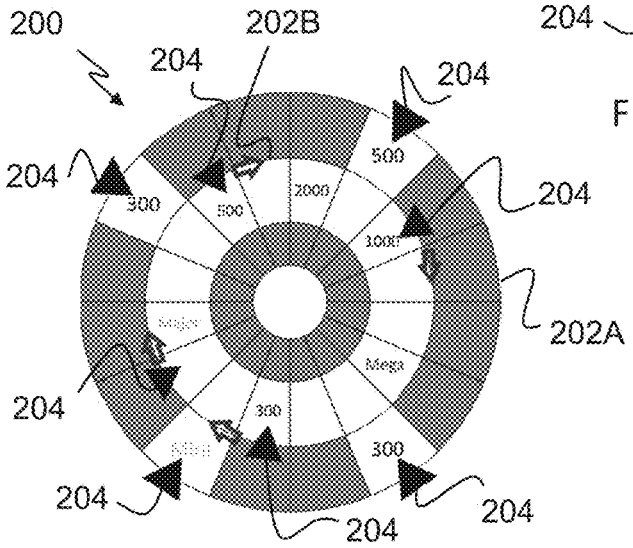

As shown in FIGS. 21B-21C, the wedges and associated indicia are displayed and the remaining pointers, which are now located about the second or middle wheel 202B, are rotated or spun about the second wheel 202B. The pointers 204 are stopped at randomly determined locations about the second wheel 202B. Any pointer 204 associated with a wedge (of the second wheel 202B) having an associated prize symbol, e.g., a credit amount or a jackpot is held. Any remaining pointers 204, i.e., that are not locked, are moved inward towards a third or innermost wheel 202C (see FIG. 21D). In the illustrated embodiment, three of the pointers 204 are held at the second wheel 202B and are associated with the following prize symbols: 100 credits; 300 credits; and 500 credits. The remaining pointer 204 is moved inward.

Figure 21D:
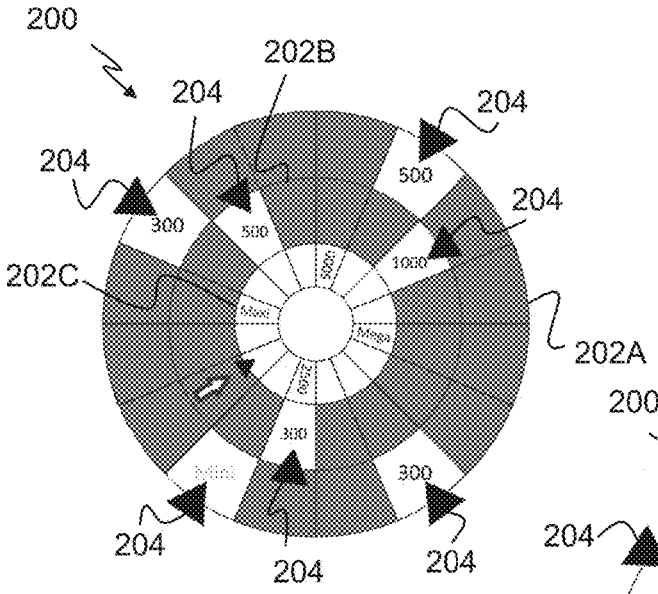
Figure 21E:
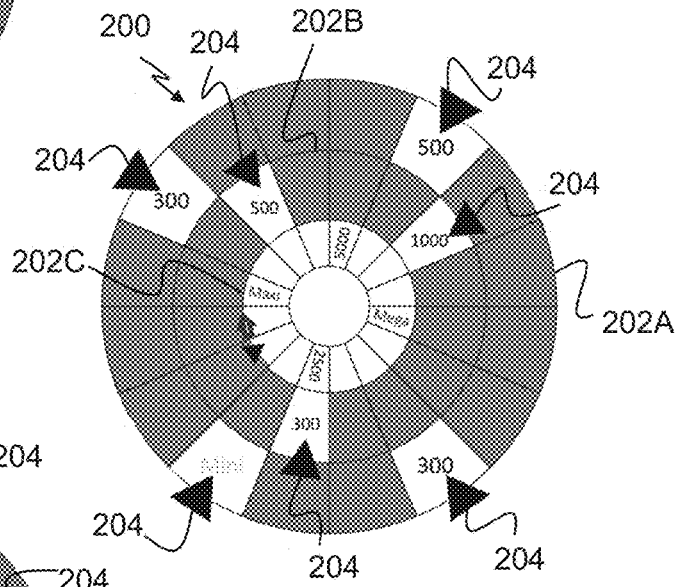
Figure 21F:
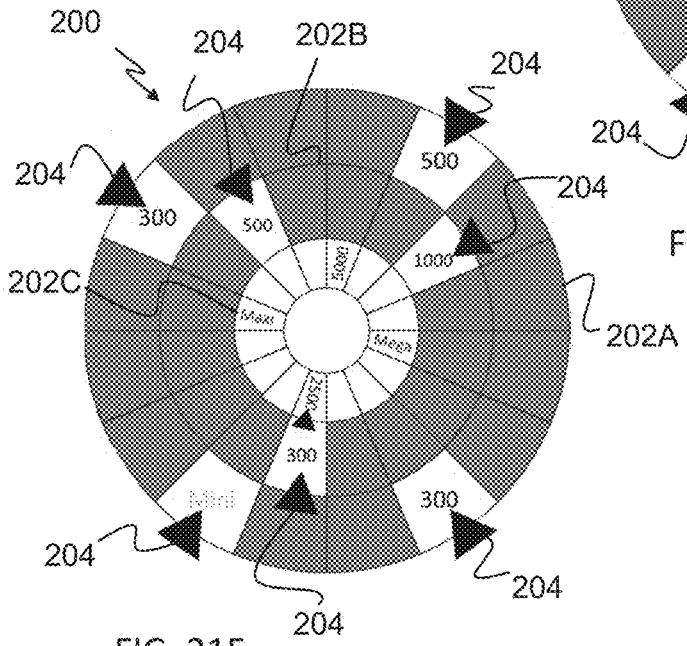

As shown in FIGS. 21D-21E, the wedges and associated indicia of the third, innermost wheel 202C are displayed and the remaining pointer(s), which are now located about the third or innermost wheel 202C, are rotated or spun about the second wheel 202B. The pointer 204 is stopped at a randomly determined location about the third wheel 202C. As shown in FIG. 21F, in the illustrated embodiment the remaining pointer 204 was stopped at a wedge of the third wheel 202C at a wedge having an associated indicia of 2,500 credits.

In the illustrated embodiment, after all three wheels 202A, 202B, 202C have been utilized, the prize awards associated with the (held) pointers are awarded to the player. In the illustrated example, the player is awarded a total of 5,400 credits, plus the Mini progressive jackpot award.

In a further embodiment, if after the pointers have spun around the third wheel 202C and a pointer lands on an upgrade symbol, e.g., a blank symbol, then is moved to a center of the feature game structure 200 and a Supreme Jackpot is awarded to the player.

Figure 22:
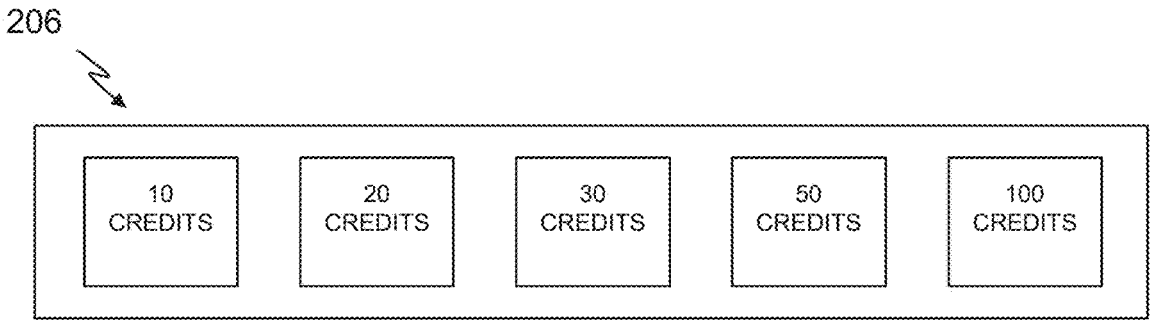
FIGS. 22-23 are diagrammatic illustrations of a series of wagering buttons utilized in a primary game and/or game feature, according to different embodiments of the present invention.

With reference to FIG. 22, a series of game feature wager buttons 206 may be utilized to allow the player to specify the amount of the game feature wager. In one embodiment, the game feature wager buttons 206 may be provided using the buttons 34 on the control panel 18. The buttons 34 may be provided by a touchscreen panel or may be mechanical buttons having embedded displays. In this manner, the labels may be dynamically modified in an appropriate manner based on the use of the button. In another embodiment, the game feature buttons 206 may be provided utilizing a touchscreen device used with the display unit 24.

As discussed above, in one embodiment the game feature wager may be 10 credits, 20 credits, 30 credits, 50 credits or 100 credits. In one embodiment, if the game feature is provided in conjunction with a primary game, a default wager, e.g., 10 credits, is required, although the player may select a different game feature wager by selecting one of the other buttons 206. As discussed above, selection of one of the game feature wagers, 10, 20, 30, 50 or 100 credits, provides 1, 2, 3, 5 and 10 pointers in the game feature, respectively.

Figure 23:
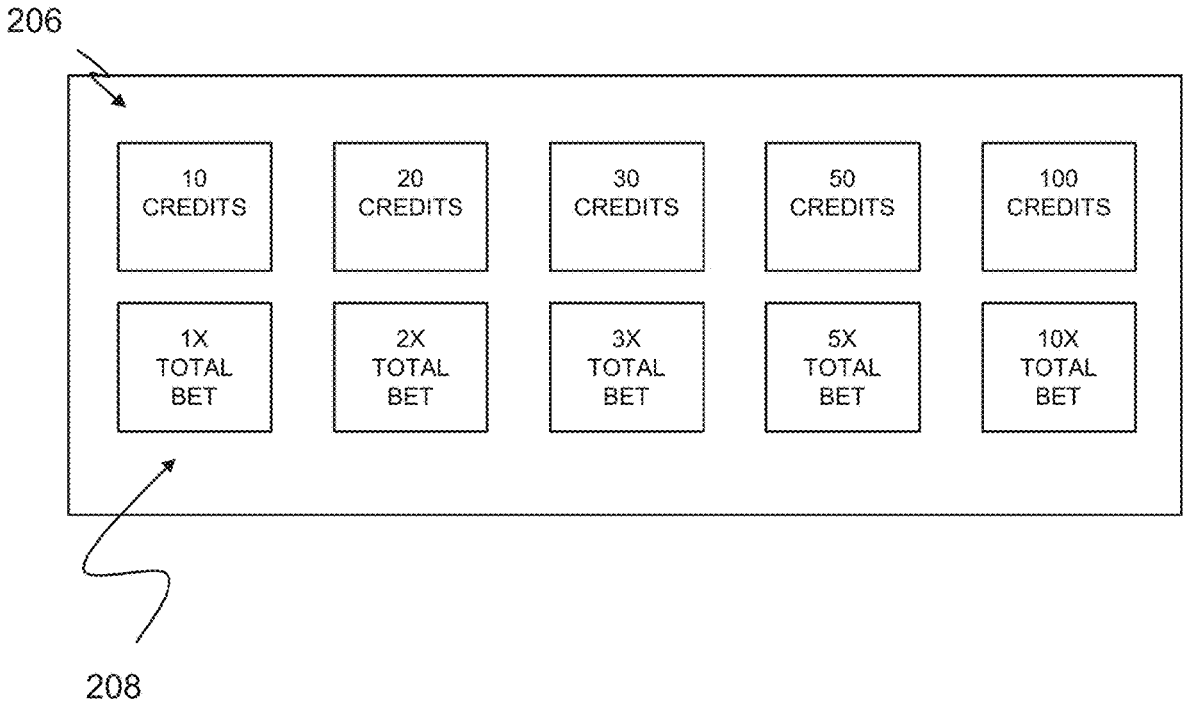

As discussed above, in another aspect of the present invention the game feature is provided in conjunction with a primary game. As shown in FIG. 3, a primary game screen 188 in the display area 64 of the display unit 24 may be shown. Before the primary game screen 188 is displayed the player is allowed to make a wager that includes a primary game wage and an extra wager, i.e., the game feature wager. With reference to FIG. 23, in one embodiment a plurality of primary game wager buttons 208 on the control panel 18 or on the display unit 24. In a specific embodiment, the primary game is a video slot game. After the player chooses the paylines to be played in the primary game, the player may select one of the primary game wager buttons 208 to specify a primary game wager. In the illustrated embodiment, a base primary game wager is determined by the paylines chosen by the player and the primary game wager buttons 208 are used to select a multiple of the base primary game wager, i.e., 1×, 2×, 3×, 5× or 10× the primary game base wager). Then the player may select one of the game feature wager buttons 206.

Figure 16:
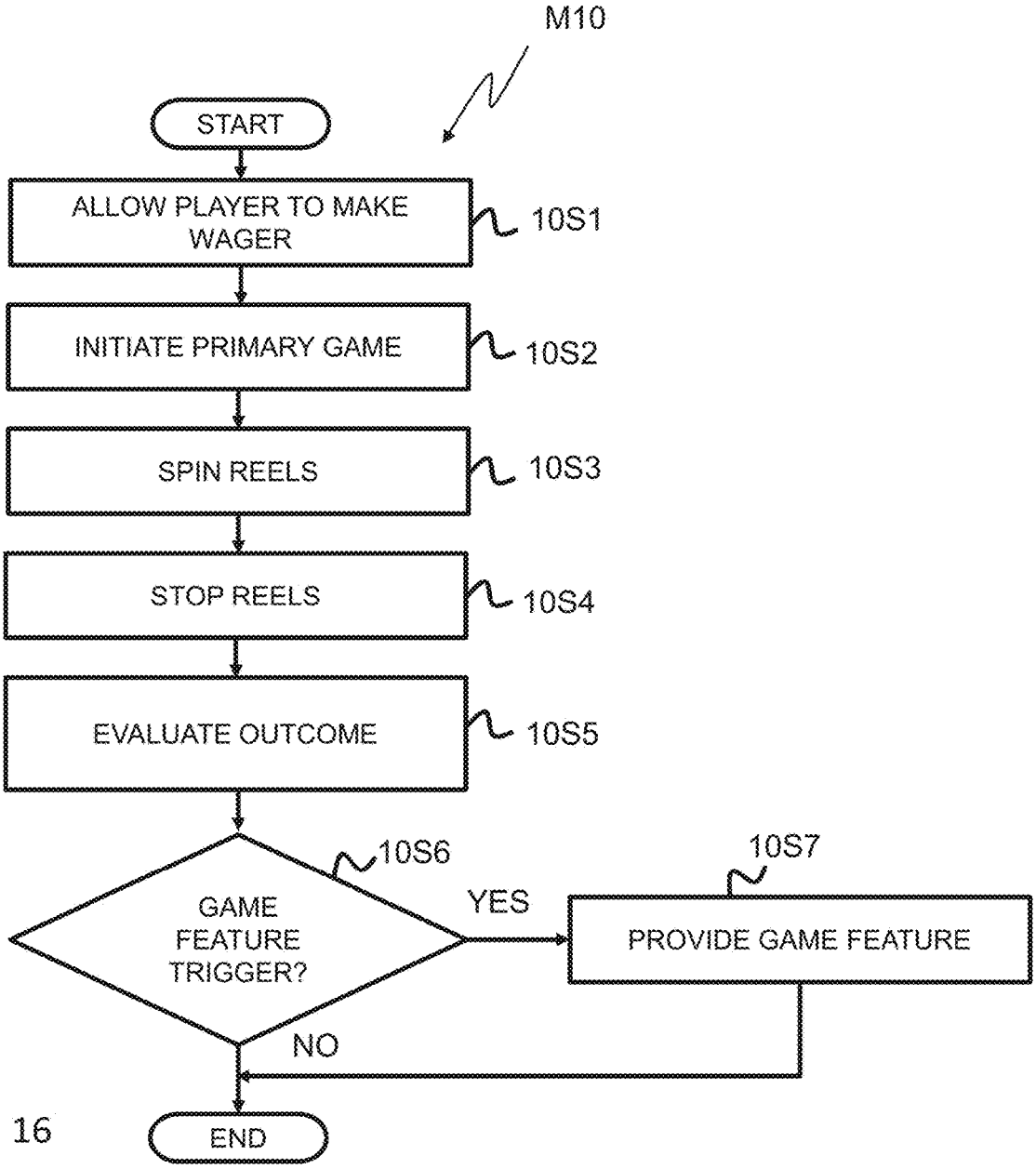
FIGS. 16-19 and 20A-20B are flow charts illustrating the algorithms used during operation of the gaming machine during a game, according to one embodiment of the present invention.

With specific reference to FIG. 16, a flow diagram M10 of an algorithm to be executed by the processor 38 to provide a primary game according to one embodiment of the present invention is shown. In a first step 10S1, the player is allowed to make a wager. In one embodiment, the player's wager includes two components: a primary wager and a game feature wager. The game feature wager may have a default or game feature base wager, e.g., 10 credits. The player may select from one or more other game feature wagers. In one embodiment, the other game feature wagers are multiples of the game feature base wager. In one embodiment, the game feature wager may be one of 10, 20, 30, 50 and 100 credits.

In a second step 10S2, the primary game is initiated. In one embodiment, the primary game may be initiated through user actuation of a spin button.

In a third step 10S3, the virtual reels 72-80 are spun. In a fourth step 10S4, the virtual reels 72-80 are stopped at randomly determine stop positions.

In a fifth step 10S5, the outcome of the primary game (defined by the symbols displayed on the stopped virtual reels 72-80) is evaluated. For example, the displayed symbols are compared against the played paylines to determine if any winning combinations have occurred. The player is then awarded an award or awards based on the winning combinations and a predetermined paytable.

In a sixth step 10S6, if a game feature trigger has been detected, then the game feature is provided in a seventh step 10S7.

Figure 17:
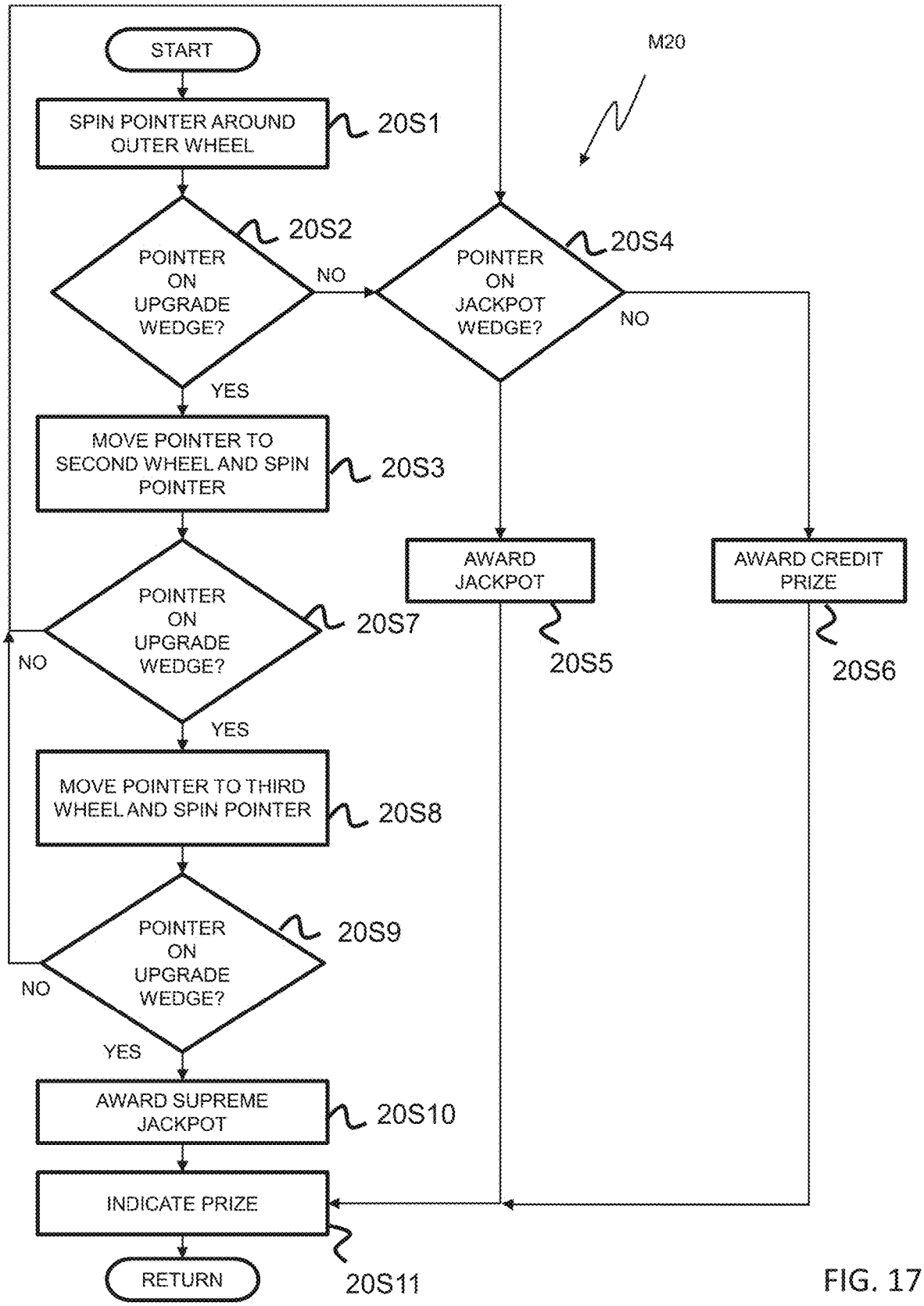

With reference to FIG. 17, a flow diagram M20 of an algorithm to be executed by the processor 38 to provide the game feature according to one embodiment of the present invention. The flow diagram M20 describes the game feature with respect to a single pointer. As discussed above, in one aspect of the present invention, the number of pointers used in the game feature is dependent upon the game feature wager. If the player chooses the default or base feature game wager, then a single pointer is used. The algorithm shown in the flow diagram M20 utilizes a single pointer. If additional pointers are used, the algorithm M20 (or a modified version) is applied to all pointers.

Prior to initiation of the game feature, the game feature structure 202, including the first wheel 202A, the wedges of the first wheel 202A and the indicia associated with the wedges of the first wheel 202A. The pointer 204 is also displayed at the outer edge or circumference of the first wheel 202A. In this embodiment, the indicia are from a set of indicia that includes prize symbols. The prize symbols include one or more jackpot symbols, a plurality of credit prize symbols and an upgrade symbol, i.e., a blank symbol.

In a first step 20S1, the pointer is spun around the first wheel and then stopped. In a second step 20S2, if the stopped pointer is located on, or associated with, an upgrade wedge, then the method M20 proceed to a third step 20S3. Otherwise, the method M20 proceeds to a fourth step 20S4. In the fourth step 20S4, if the pointer is located on, or associated with, a jackpot wedge, then the method M20 proceeds to a fifth step 20S5. Otherwise, the method M20 proceeds to a sixth step 20S6.

In the fifth step, the player is awarded the jackpot associated with the indicia on the wedge on which the pointer is located. In one embodiment, of the present invention there are four possible jackpot awards: a MINI progressive jackpot, a MAJOR progressive jackpot, a MEGA progressive jackpot, and a MAXI progressive jackpot. After the jackpot is awarded, the method M20 proceeds to an eleventh step 20S11.

In the sixth step 20S6, a credit prize associated with the indicia on the wedge on which the pointer is located is awarded to the player. In one embodiment, the credit prizes on each wheel may differ. For example, the following credit prizes may be located on each wheel:

first wheel 202A: 250, 300, 500, 750;

second wheel 202B: 250, 300, 500, 750; and, third wheel 202C: 250, 300, 500, 750, and 1000.

After the credit prize is awarded in the sixth step 20S6, the method M20 proceeds to the eleventh step 20S11.

Returning to the second step 20S2, if the pointer is located on an upgrade wedge, the method M20 proceeds to the third step 20S3. In the third step 20S3, the pointer is moved to the second wheel 202B. The pointer is spun about the second wheel 202B and stopped at a randomly determined location on the second wheel 202B.

In a seventh step 20S7, if the pointer is not located on or associated with an upgrade wedge on the second wheel 202B, then the method M20 proceeds to the fourth step 20S4 to determine if the jackpot or credit prize should be awarded to the player (see above).

If, in the seventh step 20S7, the pointer is located on or associated with an upgrade wedge, then the method M20 proceeds to an eighth step 20S8. In the eighth step 20S8, the pointer is moved to the third wheel 202C. The pointer is spun about the third wheel 202C and stopped at a randomly determined location on the third wheel 202C. Then the method M20 proceeds to a ninth step 20S9.

If, in the ninth step 20S9, the pointer is located on or associated with an upgrade wedge, then the method M20 proceeds to a tenth step 20S10. In the tenth 20S10, the pointer may be moved to the center of the game feature structure 200 and the player is awarded a SUPREME jackpot. Then the method M20 proceeds to the eleventh step 20S11.

In the ninth step 20S9, if the pointer is not located on or associated with an upgrade wedge on the third wheel 202C, then the method M20 proceeds to the fourth step 20S4 to determine if the jackpot or credit prize should be awarded to the player (see above).

In the eleventh step 20M11, the prize (or total prize(s) if more than one pointer is used) is displayed to the player and then the method 20M ends or returns to method M10.

Figure 18:
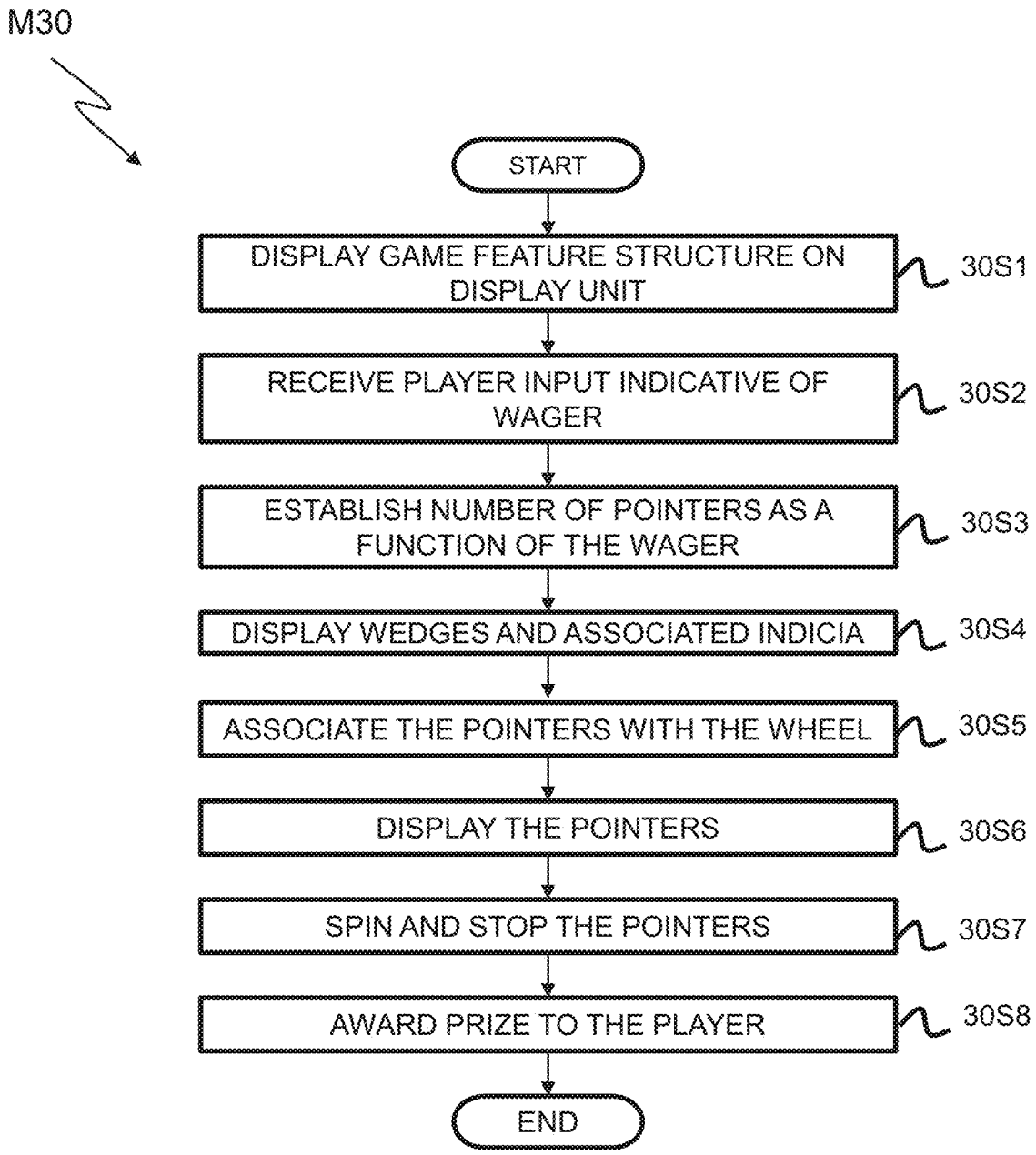

With reference to FIG. 18, an algorithm for providing a flow diagram M30 of an algorithm to be executed by the processor 38 to provide the game feature according to another embodiment of the present invention is shown. In the flow diagram M30, the game feature may be provided in conjunction with a primary game or as a standalone game. In this embodiment, the game feature structure 200 has a single wheel 202A.

In a first step 30S1, the game feature structure 200 is displayed on the display unit 24. In a second step 30S2, the processor 38 receives player input indicative of a wager, e.g., the player feature wager. In a third step 30S3, the processor 38 establishes a number of pointers to be used in the game feature as a function of the wager. In one aspect of the present invention, the number of pointers may be directly related to the size of the wager. In one embodiment, there is a default or base wager which provides a single pointer. The player may wager different multiples of the base wager which provides additional pointers based on the multiple of the default wager.

In a fourth step 30S4, the wedges and associated indicia are displayed on the game feature structure 200 on the display unit 24.

In a fifth step 30S5, the pointers 204 are associated with the wheel 202A. The pointers 204 are displayed on the wheel 202A in a sixth step 30S6. In a seventh step 30S7, the pointers are spun and stopped at randomly determined locations around the wheel 202A. In an eighth step 30S8, the prizes associated with any indicia on a wedge on which a pointer 204 has stopped are awarded to the player.

Figure 19:
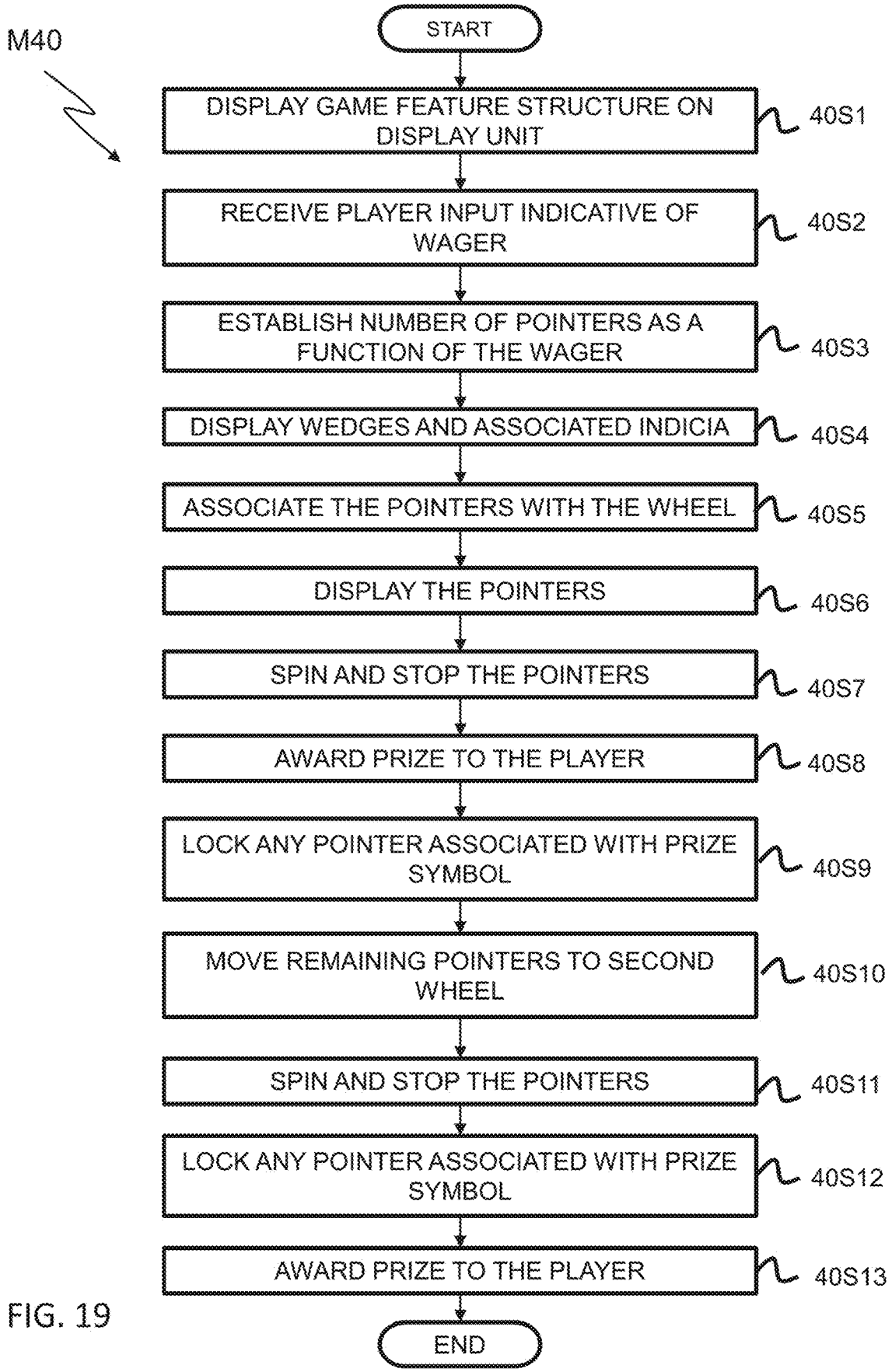

With reference to FIG. 19, an algorithm for providing a flow diagram M40 of an algorithm to be executed by the processor 38 to provide the game feature according to another embodiment of the present invention is shown. In the flow diagram M40, the game feature may be provided in conjunction with a primary game or as a standalone game. In this embodiment, the game feature structure 200 has two wheels 202A, 202B.

In a first step 40S1, the game feature structure 200 is displayed on the display unit 24. In a second step 40S2, the processor 38 receives player input indicative of a wager, e.g., the player feature wager. In a third step 40S3, the processor 38 establishes a number of pointers to be used in the game feature as a function of the wager. In one aspect of the present invention, the number of pointers may be directly related to the size of the wager.

In a fourth step 40S4, the wedges and associated indicia are displayed on the game feature structure 200 on the display unit 24.

In a fifth step 40S5, the pointers 204 are associated with the first wheel 202A. The pointers 204 are displayed on the first wheel 202A in a sixth step 40S6. In a seventh step 40S7, the pointers are spun and stopped at randomly determined locations around the first wheel 202A. In an eighth step 40S8, the prizes associated with any indicia on a wedge on which a pointer 204 has stopped are awarded to the player.

In a ninth step 40S9, any pointers that are associated with a prize symbol are locked. Any remaining pointers, i.e., pointers that are not locked, are moved to the second wheel 202B in a tenth step 40S10. In one embodiment, any pointers that are located on or associated with a wedge having a prize symbol are moved. In one embodiment, wedges not associated with a prize symbol have an indicia indication of a blank or an upgrade symbol.

In an eleventh step 40S11, the pointers which have been moved to the second wheel 202B are spun about the second wheel 202B and stopped. In a twelfth step 40S12, any pointer 204 which is located on a wedge associated with a prize symbol is locked.

In a thirteen step 40S13, the prizes associated with any indicia on a wedge on which a pointer 204 has stopped are awarded to the player.

Figure 20A:
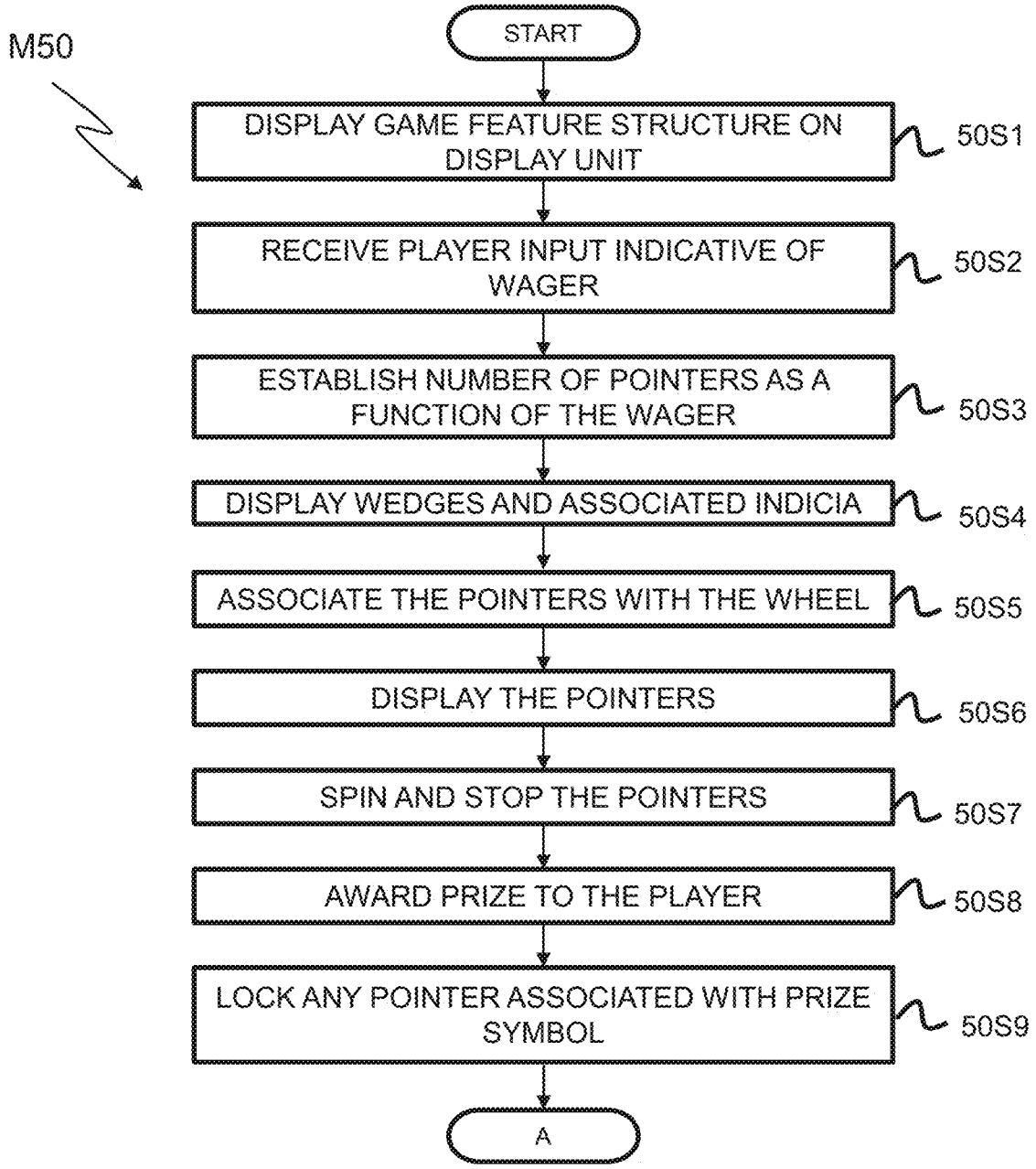
Figure 20B:
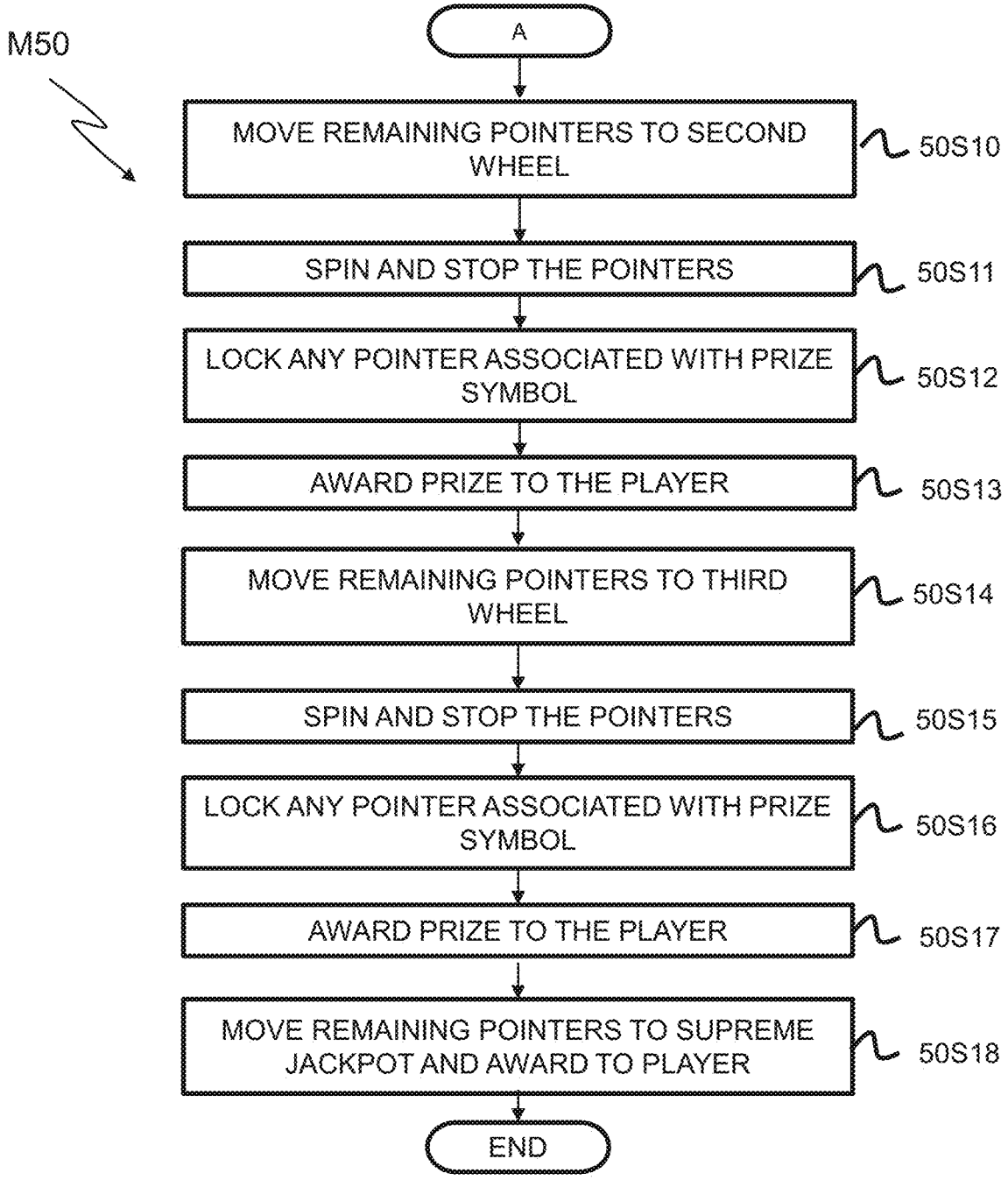

With reference to FIGS. 20A-20B, an algorithm for providing a flow diagram M50 of an algorithm to be executed by the processor 38 to provide the game feature according to another embodiment of the present invention is shown. In the flow diagram M50, the game feature may be provided in conjunction with a primary game or as a standalone game. In this embodiment, the game feature structure 200 has three wheels 202A, 202B, 202C.

In a first step 50S1, the game feature structure 200 is displayed on the display unit 24. In a second step 50S2, the processor 38 receives player input indicative of a wager, e.g., the player feature wager. In a third step 50S3, the processor 38 establishes a number of pointers to be used in the game feature as a function of the wager. In one aspect of the present invention, the number of pointers may be directly related to the size of the wager.

In a fourth step 50S4, the wedges and associated indicia are displayed on the game feature structure 200 on the display unit 24.

In a fifth step 50S5, the pointers 204 are associated with the first wheel 202A. The pointers 204 are displayed on the first wheel 202A in a sixth step 50S6. In a seventh step 50S7, the pointers are spun and stopped at randomly determined locations around the first wheel 202A. In an eighth step 40S8, the prizes associated with any indicia on a wedge on which a pointer 204 has stopped are awarded to the player.

In a ninth step 50S9, any pointers that are associated with a prize symbol are locked. Any remaining pointers, i.e., pointers that are not locked, are moved to the second wheel 202B in a tenth step 50S10. In one embodiment, any pointers that are located on or associated with a wedge having a prize symbol are moved. In one embodiment, wedges not associated with a prize symbol have an indicia indication of a blank or an upgrade symbol.

In an eleventh step 50S11, the pointers which have been moved to the second wheel 202B are spun about the second wheel 202B and stopped. In a twelfth step 50S12, any pointer 204 which is located on a wedge associated with a prize symbol is locked.

In a thirteen step 50S13, the prizes associated with any indicia on a wedge on which a pointer 204 has stopped are awarded to the player.

Any remaining pointers, i.e., pointers that are not locked, are moved to the third wheel 202C in a fourteenth step 50S14. In one embodiment, any pointers that are located on or associated with a wedge having a prize symbol are moved. In one embodiment, wedges not associated with a prize symbol have an indicia indication of a blank or an upgrade symbol.

In a fifteenth step 50S15, the pointers which have been moved to the third wheel 202C are spun about the second wheel 202B and stopped. In a sixteenth step 50S16, any pointer 204 which is located on a wedge associated with a prize symbol is locked.

In a seventeenth step 50S17, the prizes associated with any indicia on a wedge on which a pointer 204 has stopped are awarded to the player.

In an eighteenth step 50S18, any remaining, i.e., unlocked pointers are moved to the center of the game feature structure 200 and a SUPREME jackpot is awarded to the player.

With reference to FIGS. 24-28, in one embodiment, the game feature is embodied in a progressive game feature under the name Power Boost Inferno. The Power Boost Inferno progressive game is provided in conjunction with a primary game. The Power Boos Inferno progressive game includes five progressive jackpots: a MINI progressive jackpot, a MAJOR progressive jackpot, a MEGA progressive jackpot, a MAXI progressive jackpot and a SUPREME progressive jackpot. As discussed above, progressive jackpots may be paid from respective progressive pools.

In general, contributions are made to the progressive pools from the wagers placed by players. In the Power Boost Inferno progressive game, the MINI, MAJOR, MEGA and MAXI progressive jackpots are standalone progressive. In other words, contributions to the respective pools are made only by wagers made on the same gaming machine or device. Additionally, the SUPREME progressive jackpot is a linked progressive. In other words, contributions to the respective pool may be made from wagers made by players at a plurality of linked gaming machines.

As discussed in more detail below, the game feature structure 200 includes three concentric, static wheels. Each wheel has a number of wedges and has an associated indicia. In the illustrated embodiment, each wheel has a different number of wedges. The indicia are from a set of indicia that includes a plurality of prize symbols and an upgrade symbol. In the illustrated embodiment, the upgrade symbol is an inward pointing arrow. The plurality of prize symbols includes a plurality of credit prizes and MINI, MAJOR, MEGA and MAXI progressive jackpot symbols. When one of the progressive jackpots are paid out, the respective pool is reset to a reset value.

As discussed above, in general, the pointers are rotated or spun around each of the wheels in turn. The pointers are stopped at random locations about the wheel and the player is awarded the prize associated with the indicia on the wedge on which the pointers are stopped. If a pointer has stopped on an upgrade symbol, then it is moved the next wheel. If a pointer makes it the center of the game feature structure, then the player is awarded the SUPREME progressive jackpot.

Prior to initiation of the primary game, the player must make a wager. The wager has two components: a primary game wager and an extra wager. The primary game wager is based on the options made by the player. For example, if the primary game is a video slot game, the wager may be a function of the paylines played by the player and/or a multiplier to be applied to the wager. The player must make an extra wager. However, the player may choose the size of the extra wager. In the Power Boost Inferno progressive game, the player make an extra wager in the amount of 10, 20, 30, 50 and 100 credits. If triggered, the game feature uses 1, 2, 3, 5 and 10 pointers in response to an extra wager of 10, 20, 30, 50 and 100 credits, respectively.

With reference to FIGS. 24-27, the game feature manager 131 may utilize a number of data tables to operate or manage the game feature. In general, by changing the values in these tables, the operation of the Power Boost Inferno progressive game may be modified.

The gaming machine may convert currency into credits using a currency ratio, commonly referred to as the denomination or "denom" of the gaming machine. In the illustrated embodiment, the gaming machine may have a denom of: $0.01; $0.02; $0.05; $0.10; $0.25; $0.50; $1.00; $2.00; and $5.00. With specific reference to FIG. 24, a reset amount table may be used to specify the amount to which each progressive pool (per denom) is reset after the respective progressive has been won or award.

With specific reference to FIG. 25, a credit data table may be used by the game feature manager 131 to populate each wheel 202A, 202B, 202C with credit values.

As discussed above, the progressive pools are funded by contributions made from the extra wagers (as defined by a percent contribution of the extra wager). With specific reference to FIG. 26, a sample contribution table, listing the percent contribution made from each extra wager to the respective progressive pools.

With specific reference to FIG. 27, a wheel layout data table specifies the indicia associated with each wedge in each wheel.

Figure 28:
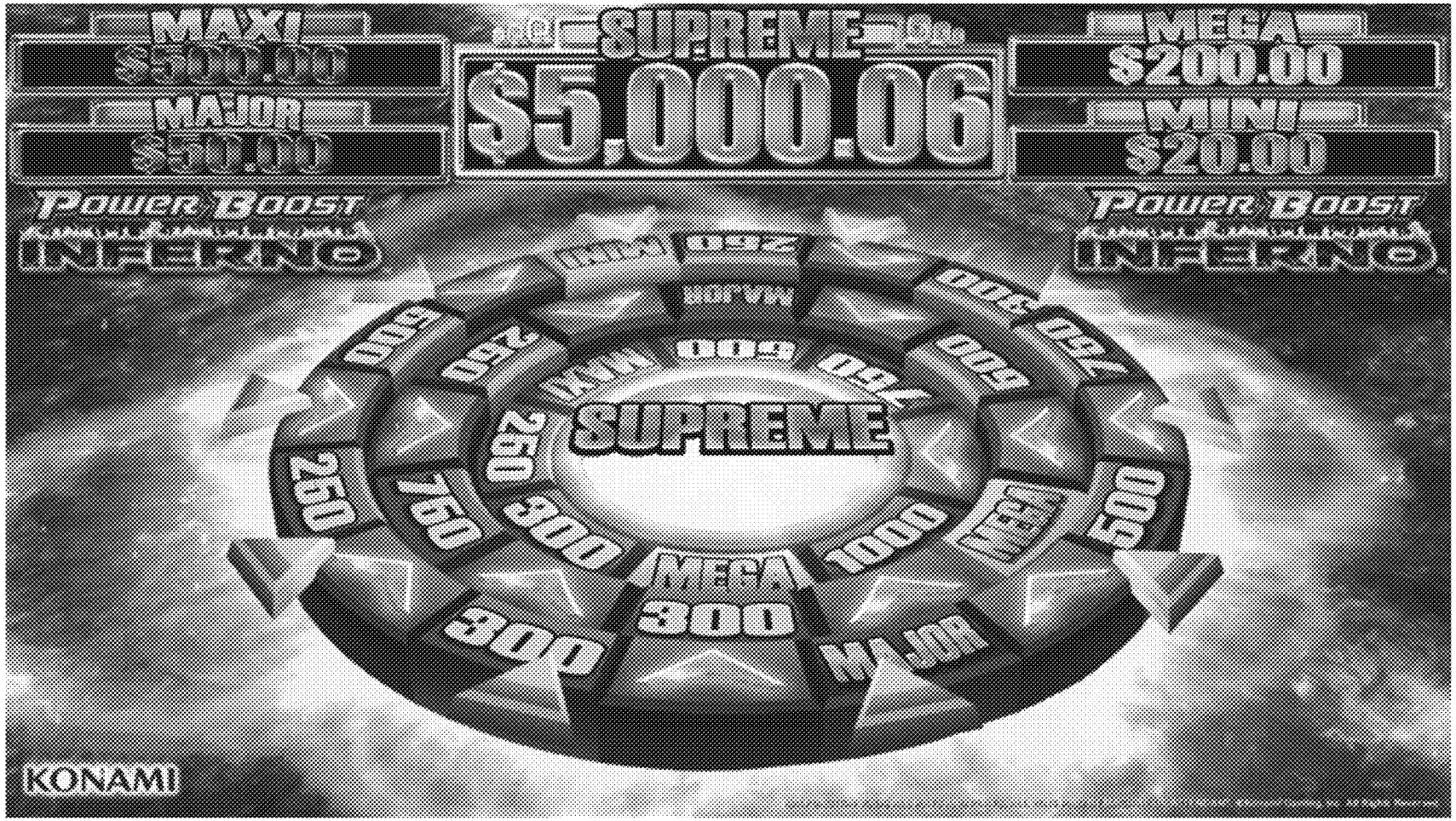
FIG. 28 is an exemplary screen shot of a game feature structure used in the game feature, according to an embodiment of the present invention.

With reference to FIG. 28, a sample screen shot of the game feature structure 200 of the Power Boost Inferno progressive game is shown. In the illustrated embodiment, all three wheels 202A, 202B, 202C are shown with 10 pointers.

Referring to FIGS. 16-19 and 20A-20B, in one embodiment, the processor 38 may implement one or more of the methods M10, M20, M30, M40, M50 to execute the primary game and/or the game feature as a bonus game or a stand-alone game.

In one embodiment the game feature is provided as a stand-alone game. Prior to the initiating of the game feature, the processor 38 determines the number of pointers to be used in the game feature based on the game feature the player has selected using the game feature wager buttons 206.

In another embodiment, the game feature is provided in conjunction with a primary game, prior to initiating an instance of the primary game, the processor 38 determines the number of pointers to be used in the bonus game based on the game feature or extra wager the player has selected using the game feature wager buttons 206.

In one embodiment, during the primary game, the processor 38 randomly determines an outcome of an instance of the primary game and spins the virtual reel strips 72 to 80 and sequentially stops the virtual reel strips 72 to 80 to display the randomly generated outcome including a game symbol being displayed in each cell 70 of the grid 68. For example, in one embodiment, the processor 38 may execute one or more of the algorithms M10, M20, M30, M40, M50 shown in FIGS. 16-19 and 20A-20B, including receiving a signal indicating the player depressing the spin button and start spinning each virtual reel strip 72 to 80, obtain random numbers from the random number generator 108, and determine a stop position of each virtual reel strip 72 to 80 based on the random numbers and the stop position data file. In one embodiment, the processor may obtain a random number for each simulate virtual reel strip 72 to 80, i.e. five random numbers. The processor 38 then established a reel stop counter, "i", and sets the reel stop counter, i, equal to x. The processor 38 then identifies the $i^{th}$ virtual reel strip associated with the stop counter, i, and stops the identified virtual reel strip to display the corresponding symbols in the corresponding cells 70 associated with the identified virtual reel strip. The processor then increments the reel stop counter, i, by x, i.e. i=i+x, and repeats the process of identifying the virtual reel strip associated with the incremented reel stop counter and stopping the identified virtual reel strip. This process continues until each virtual reel strip has been stopped. In this embodiment, for example, the virtual reel strips are numbered 1-5. In one embodiment, during the reel spin, the player may initiate the stopping of the reels by depressing the spin button, which enables the player to accelerate game play.

In one embodiment, upon receiving a signal indicating the player depressing the spin button, the processor may generate each virtual reel strip 72 to 80 for use during the instance of the primary game 202. For example, in one embodiment, the processor 38 may execute the game application program 92 using the reel layout table 132 for use in generating each virtual reels 72 to 80. The processor 38 may accesses the reel layout table 132 and identify a reel designation 260 and stop position 262 associated with the virtual reel being generated, and access each sequential symbol position logic cell 264 for generating and displaying the corresponding game symbols. The processor 38 then generates the corresponding virtual reel strip based on the instructions associated with each sequential symbol position logic cell 264, associated with the reel designation 260. In addition, the processor 38 accesses the inner symbol table 138 to randomly select a symbol that is populated in symbol position designating a varying symbol ("inn"). Each "inn" logic cell is transformed into PicA, PicB, PicC, PicD, A, K, Q, J, 10 or 9 in each game, such that each "inn" logic cell is populated with the same symbol.

Upon stopping the virtual reel strips 72 to 80, the processor 38 determines if any winning combination of symbols is displayed in the outcome if the instance of the primary game 202, and determines an initial award associated with the winning outcome. In one embodiment, the processor 38 detects an appearance of a winning combination of game symbols in the outcome based on the paylines shown in FIG. 6, and provides an initial award based on the winning combination of symbols and a paytable.

In the illustrated embodiment, upon stopping the virtual reel strips 72 to 80 to display the outcome of the instance of the primary game 202, the processor 38 determines if a game feature or bonus triggering condition has occurred, and if so, the game feature manager 131 establishes the number of pointers to be utilized and provides the game feature.

In such an embodiment, a gaming machine 10 may provide a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

In the embodiment, determining the stop position of each reel is described as consecutively acquiring a random number that is used respectively, but the acquisition procedure of the random number is not limited to this. For example, when the game starts, the control unit 22 acquires these random numbers in a batch, and each random number may be stored in the storage area of the non-erasing memory 42 or the storage 44 when power failure occurs. In this type of situation, even when a power failure and the like occurs during a game, because the control unit 22 acquired the random number from the memory 42 or the storage 44 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 42 or the storage 44, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 22 randomly determines the step position of all reels. The control unit 22 may perform the check for the trigger condition before the reels stop spinning, and thus has already determined the outcome of the game. However, the control unit 22 displays the outcome of the game in a step by step process as discussed above.

Further, in the embodiment, a bill/ticket is displayed as game value, and received by these bill/ticket identification devices, and a form where a ticket is output by a printer device 30 is described, but the present invention is not limited to this. The game value is a concept including tangible objects such as a coin, bill, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strips from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game feature to a player, comprising:

an operation unit configured to receive an operation input of the player to initiate the game feature;

a display unit coupled to the operation unit and configured to display a game screen including a game feature structure, the game feature structure including a wheel having a plurality of wedges, each wedge having an associated indicia, the indicia being from a set of indicia including a plurality of prize symbols, the game feature structure being displayed using computer generated graphics;

a memory device coupled to the operation unit and the display unit and being configured to store a game execution program including computer instructions for generating the game feature; and a game control unit for executing the game execution program to provide the game feature, the game control unit coupled to the operation unit, the display unit and the memory device, the game control unit including a processor programmed to:

prior to initiation of the game feature, display the game feature structure on the game screen on the display unit;

receive the operation input from the player through the operation unit, the operation input being indicative of a wager made by the player;

initiate the game feature;

establish a number of pointers as a function of the wager made by the player, wherein the number of pointers is directly related to the wager;

display the wedges and associated indicia on the wheel;

associate the established number of pointers with the wheel;

display the selected number of pointers on the game screen;

display the selected number of pointers independently spinning about the wheel;

stop and display the selected number of pointers about the wheel, each pointer being associated with one of the wedges of the wheel when the selected number of pointers stop; and, award a prize to the player represented by any prize symbol on the wedges associated with the pointers.

2. A gaming machine, as set forth in claim 1, wherein the plurality of prize symbols includes a plurality of credit amounts and/or one or more progressive awards.

3. A gaming machine, as set forth in claim 1, wherein at least a portion of the wager is a multiple of a base feature wage, wherein the number of pointers used in the game feature is directly related to the multiple of the base feature wager.

4. A gaming machine, as set forth in claim 1, wherein the display unit is further configured to display a primary game on the game screen, the primary game including a plurality of cells arranged in a grid, and wherein the processor of the game control unit is further programmed to:

display the primary game;

detect a triggering condition; and responsively provide the game feature in response to detecting the triggering condition.

5. A gaming machine, as set forth in claim 4, wherein the processor of the game control unit is further programmed to:

allow the player to make a primary game wager associated with the primary game using the operation unit;

allow the player to make an extra wager, the wager made by the player being equal to the sum of the primary game wager and the extra wager.

6. A gaming machine, as set forth in claim 5, wherein the processor of the game control unit is further programmed to establish the number of pointers used in the game feature as a function of the extra wager.

7. A gaming machine, as set forth in claim 6, wherein the extra wager is a multiple of a base feature wage, wherein the number of pointers used in the game feature is directly related to the multiple of the base feature wager.

8. A gaming machine, as set forth in claim 1, wherein the game feature structure includes a second wheel, the wheel and the second wheel being concentric, the second wheel having a plurality of wedges, each wedge of the second wheel having an associated indicia, the indicia associated with each wedge of the second wheel being from the set of indicia, the set of indicia including the plurality of prize symbols and a special symbol, the processor of the game control unit being further programmed to:

after the pointers are independently spun and stopped about the wheel, lock any pointer which is associated with one of the wedges of the wheel having an associated prize symbol;

associate any remaining pointers, which are associated with one of the wedges of the wheel having an associated special symbol, with the second wheel;

move the remaining pointers to the second wheel;

independently spin and stop the remaining pointers associated with the second wheel about the second wheel, each remaining pointer being associated with one of the wedges of the second wheel when the remaining pointers stop; and, lock any of the remaining pointers which are associated with one of the wedges of the second wheel having an associated prize symbol.

9. A gaming machine, as set forth in claim 8, wherein the second wheel is one of an inner wheel and an outer wheel relative to the wheel.

10. A gaming machine, as set forth in claim 8, wherein the indicia on the wedges of the wheel are displayed after the pointers are locked.

11. A gaming machine, as set forth in claim 8, wherein the game feature structure includes a third wheel, the wheel, the second wheel and the third wheel being concentric, the third wheel having a plurality of wedges, each wedge of the third wheel having an associated indicia, the indicia associated with each wedge of the third wheel being from the set of indicia, the processor of the game control unit being further programmed to:

after the remaining pointers are independently spun and stopped about the second wheel, lock any pointer which is associated with one of the wedges of the second wheel having an associated prize symbol;

associate any secondary remaining pointers, which are associated with one of the wedges of the second wheel having an associated special symbol, with the third wheel;

move the secondary remaining pointers to the third wheel;

independently spin and stop the secondary remaining pointers associated with the third wheel about the third wheel, each secondary remaining pointer being associated with one of the wedges of the third wheel when the secondary remaining pointers stop; and, lock any of the secondary remaining pointers which are associated with one of the wedges of the third wheel having an associated prize symbol.

12. A gaming machine, as set forth in claim 11, wherein the second wheel is inside the wheel and the third wheel is inside the second wheel.

13. A gaming machine, as set forth in claim 11, wherein the plurality of prize symbols includes a plurality of credit amounts and/or one or more progressive awards.

14. A gaming machine, as set forth in claim 11, wherein the display unit is further configured to display a primary game on the game screen, the primary game including a plurality of cells arranged in a grid, and wherein the processor of the game control unit is further programmed to:

display the primary game;

detect a triggering condition; and responsively provide the game feature in response to detect the triggering condition.

15. A gaming machine, as set forth in claim 14, wherein the processor of the game control unit is further programmed to:

allow the player to make a primary game wager associated with the primary game using the operation unit;

allow the player to make an extra wager, the wager made by the player being equal to the sum of the primary game wager and the extra wager.

16. A gaming machine, as set forth in claim 15, wherein the processor of the game control unit is further programmed to establish the number of pointers used in the game feature as a function of the extra wager.

17. One or more non-transitory computer-readable storage media, having computer-executable instructions embodied thereon, wherein when executed by a processor, the computer-executable instructions cause the processor to:

display, on a display unit, a game screen using computer generated graphics;

receive an operation input of the player on an operation unit;

store a game execution program including computer instructions for generating the game feature on a memory device;

prior to initiation of the game feature, display a game feature structure on the game screen on the display unit, the game feature structure including a wheel having a plurality of wedges, each wedge having an associated indicia, the indicia being from a set of indicia including a plurality of prize symbols;

receive the operation input from the player through the operation unit, the operation input being indicative of a wager made by the player;

initiate the game feature;

establish a number of pointers as a function of the wager made by the player, wherein the number of pointers is directly related to the wager;

display the wedges and associated indicia on the wheel;

associate the established number of pointers with the wheel;

display the selected number of pointers on the game screen;

display the selected number of pointers independently spinning about the wheel;

stop and display the selected number of pointers about the wheel, each pointer being associated with one of the wedges of the wheel when the selected number of pointers stop; and, award a prize to the player represented by any prize symbol on the wedges associated with the pointers.

18. The one or more non-transitory computer-readable storage media of claim 17, wherein the plurality of prize symbols includes a plurality of credit amounts and/or one or more progressive awards.

19. The one or more non-transitory computer-readable storage media of claim 17, wherein at least a portion of the wager is a multiple of a base feature wage, wherein the number of pointers used in the game feature is directly related to the multiple of the base feature wager.

20. The one or more non-transitory computer-readable storage media of claim 17, the computer-executable instructions further cause the processor to:

display a primary game, the primary game including a plurality of cells arranged in a grid on the game screen on the display unit;

detect a triggering condition; and responsively provide the game feature in response to detect the triggering condition.

21. The one or more non-transitory computer-readable storage media of claim 20, the computer-executable instructions further cause the processor to:

allow the player to make a primary game wager associated with the primary game using the operation unit;

allow the player to make an extra wager, the wager made by the player being equal to the sum of the primary game wager and the extra wager.

22. The one or more non-transitory computer-readable storage media of claim 21, the computer-executable instructions further cause the processor to establish the number of pointers used in the game feature as a function of the extra wager.

23. The one or more non-transitory computer-readable storage media of claim 22, wherein the extra wager is a multiple of a base feature wage, wherein the number of pointers used in the game feature is directly related to the multiple of the base feature wager.

24. The one or more non-transitory computer-readable storage media of claim 17, wherein the game feature structure includes a second wheel, the wheel and the second wheel being concentric, the second wheel having a plurality of wedges, each wedge of the second wheel having an associated indicia, the indicia associated with each wedge of the second wheel being from the set of indicia, the set of indicia including the plurality of prize symbols and a special symbol, wherein the computer-executable instructions further cause the processor to:

after the pointers are independently spun and stopped about the wheel, lock any pointer which is associated with one of the wedges of the wheel having an associated prize symbol;

associate any remaining pointers, which are associated with one of the wedges of the wheel having an associated special symbol, with the second wheel;

move the remaining pointers to the second wheel;

independently spin and stop the remaining pointers associated with the second wheel about the second wheel, each remaining pointer being associated with one of the wedges of the second wheel when the remaining pointers stop; and, lock any of the remaining pointers which are associated with one of the wedges of the second wheel having an associated prize symbol.

25. The one or more non-transitory computer-readable storage media of claim 24, wherein the second wheel is one of an inner wheel and an outer wheel relative to the wheel.

26. The one or more non-transitory computer-readable storage media of claim 24, wherein the indicia on the wedges of the wheel are displayed after the pointers are locked.

27. The one or more non-transitory computer-readable storage media of claim 24, wherein the game feature structure includes a third wheel, the wheel, the second wheel and the third wheel being concentric, the third wheel having a plurality of wedges, each wedge of the third wheel having an associated indicia, the indicia associated with each wedge of the third wheel being from the set of indicia, the processor of the game control unit being further programmed to:

after the remaining pointers are independently spun and stopped about the second wheel, lock any pointer which is associated with one of the wedges of the second wheel having an associated prize symbol;

associate any secondary remaining pointers, which are associated with one of the wedges of the second wheel having an associated special symbol, with the third wheel;

move the secondary remaining pointers to the third wheel;

independently spin and stop the secondary remaining pointers associated with the third wheel about the third wheel, each secondary remaining pointer being associated with one of the wedges of the third wheel when the secondary remaining pointers stop; and, lock any of the secondary remaining pointers which are associated with one of the wedges of the third wheel having an associated prize symbol.

28. The one or more non-transitory computer-readable storage media of claim 27, wherein the second wheel is inside the wheel and the third wheel is inside the second wheel.

29. The one or more non-transitory computer-readable storage media of claim 17, wherein the plurality of prize symbols includes a plurality of credit amounts and/or one or more progressive awards.

30. The one or more non-transitory computer-readable storage media of claim 27, the computer-executable instructions further cause the processor to:

display a primary game, the primary game including a plurality of cells arranged in a grid on the game screen on the display unit;

detect a triggering condition; and responsively provide the game feature in response to detect the triggering condition.

31. The one or more non-transitory computer-readable storage media of claim 30, the computer-executable instructions further cause the processor to:

allow the player to make a primary game wager associated with the primary game using the operation unit; and allow the player to make an extra wager, the wager made by the player being equal to the sum of the primary game wager and the extra wager.

32. The one or more non-transitory computer-readable storage media of claim 31, the computer-executable instructions further cause the processor to establish the number of pointers used in the game feature as a function of the extra wager.

33. A mobile computing device for providing a game feature to a player, comprising:

a touch display unit configured to display a game screen including a game feature structure, the game feature structure including a wheel having a plurality of wedges, each wedge having an associated indicia, the indicia being from a set of indicia including a plurality of prize symbols, the game feature structure being displayed using computer generated graphics;

a memory device coupled to the display unit and being configured to store a game execution program including computer instructions for generating the game feature; and a game control unit for executing the game execution program to provide the game feature, the game control unit coupled to the touch display unit and the memory device, the game control unit including a processor programmed to:

prior to initiation of the game feature, display the game feature structure on the game screen on the touch display unit;

allow the player to establish a wager using the touch display unit and receiving a responsive signal from the touch display unit indicative of the wager;

initiate the game feature;

establish a number of pointers as a function of the wager made by the player, wherein the number of pointers is directly related to the wager;

display the wedges and associated indicia on the wheel;

associate the established number of pointers with the wheel;

display the selected number of pointers on the game screen;

display the selected number of pointers independently spinning about the wheel;

stop and display the selected number of pointers about the wheel, each pointer being associated with one of the wedges of the wheel when the selected number of pointers stop; and, award a prize to the player represented by any prize symbol on the wedges associated with the pointers.

* * * * *